US005557908A

United States Patent [19]

Ozeki et al.

[11] Patent Number: 5,557,908

[45] Date of Patent: *Sep. 24, 1996

[54] COIN PROCESSING MACHINE

[75] Inventors: Masamichi Ozeki, Ashikaga; Mamoru Takasaki, Kazo; Katsuyuki Miyamoto, Kawaguchi; Mitsumasa Tsuruda, Oomiya, all of Japan

[73] Assignee: Laural Bank Machine Co., Ltd., Tokyo, Japan

[ * ] Notice: The term of this patent shall not extend beyond the expiration date of Pat. No. 5,487,2520

[21] Appl. No.: 223,684

[22] Filed: Apr. 6, 1994

[30] Foreign Application Priority Data

Apr. 15, 1993 [JP] Japan ..... 5-088701

[51] Int. Cl.[6] ..... B65B 11/04

[52] U.S. Cl. ..... 53/212; 53/500; 53/532

[58] Field of Search ..... 53/212, 500, 501, 53/532, 535; 453/31, 61, 62; 194/344

[56] References Cited

U.S. PATENT DOCUMENTS

| | | | |
|---|---|---|---|
| 3,886,957 | 6/1975 | Ushio | 53/212 |
| 4,219,985 | 9/1980 | Uchida et al. . | |
| 4,257,208 | 5/1981 | Uchida | 53/212 |
| 4,383,541 | 5/1983 | Uchida | 53/212 |
| 4,412,550 | 11/1983 | Watanabe et al. . | |
| 4,515,172 | 5/1985 | Nakamura et al. | 453/61 |
| 4,674,260 | 6/1987 | Rasmussen et al. | 53/212 |
| 4,832,655 | 5/1989 | Sakurai | 53/212 |
| 4,992,075 | 2/1991 | Miyamoto . | |
| 5,002,516 | 3/1991 | Watanabe et al. | 53/212 |
| 5,129,205 | 7/1992 | Rasmussen | 53/212 |

FOREIGN PATENT DOCUMENTS

| | | | |
|---|---|---|---|
| 432675 | 6/1991 | European Pat. Off. . | |
| 546772 | 6/1993 | European Pat. Off. . | |
| 3942186 | 6/1990 | Germany . | |
| 4027566 | 3/1992 | Germany | 453/61 |
| 59-84721 | 5/1984 | Japan | 53/212 |
| 2076373 | 12/1981 | United Kingdom . | |

*Primary Examiner*—John Sipos
*Assistant Examiner*—Ed Tolan
*Attorney, Agent, or Firm*—Cushman, Darby & Cushman

[57] ABSTRACT

A coin processing machine comprises a rotatable disk receiving deposited coins and feeding out the received coins to a coin sorting passage by a centrifugal force produced by rotation thereof. The coin sorting passage has a pair of guide members. The denomination of coins to be processed is selected, and the coins which are fed out to the coin sorting passage are processed in accordance with the denomination selected. The coin processing machine further comprises data storage of data concerning the denomination of coins to be processed. The coin data is input into the data storage. A controller reads out the coin data from the data storage in accordance with the denomination selected so as to control the coin processing.

11 Claims, 15 Drawing Sheets

DETECTION SIGNAL OF PHOTOSENSOR

POST ELEVATING AND LOWERING CAM

POST RETRACTING CAM

FIRST WRAPPING ROLLER POSITION ADJUSTING CAM

CRIMP CLAW RETRACTING CAM

FIG. 13A

| | DENOMINATION | COIN DIAMETER | COIN THICKNESS | REFERENCE WRAPPING UNIT NUMBER |
|---|---|---|---|---|
| RD1 | 1YEN | 20.0 | 1.50 | 50 |
| RD2 | 5YEN | 22.0 | 1.50 | 50 |
| RD3 | 10YEN | 23.5 | 1.50 | 50 |
| RD4 | 50YEN | 21.0 | 1.75 | 50 |
| RD5 | 100YEN | 22.6 | 1.70 | 50 |
| RD6 | 500YEN | 26.5 | 1.80 | 50 |

RD

FIG. 13B

| | DENOMINATION | COIN DIAMETER | COIN THICKNESS | REFERENCE WRAPPING UNIT NUMBER |
|---|---|---|---|---|
| ND1 | ***** | **.* | *.** | ** |
| ND2 | ***** | **.* | *.** | ** |
| ND3 | : | : | : | : |
| ND4 | : | : | : | : |
| ND5 | : | : | : | : |
| ND6 | : | : | : | : |

ND

COIN PROCESSING MACHINE

BACKGROUND OF THE INVENTION

The present invention relates to a coin processing machine such as a coin wrapping machine, a coin counting machine or the like and, in particular, to a coin processing machine comprising a rotatable disk for receiving deposited coins and feeding out the received coins of predetermined denominations to a coin sorting passage by a centrifugal force produced by rotation thereof, a pair of guide members. Denomination setting means selects the denomination of the coins to be processed, and coin processing means processes coins fed out to the coin sorting passage in accordance with the denomination selected by the denomination setting means.

DESCRIPTION OF THE PRIOR ART

A coin processing machine such as a coin wrapping machine, a coin counting machine or the like is generally constituted so as to feed deposited coins from a rotatable disk to a coin sorting passage having a pair of guide members so as to drop coins having a smaller diameter than that of the coins of the denomination to be processed, through a spacing between the pair of guide members. In this way, only the coins to be processed are passed therethrough with these coins being held between the upper surface of the coin sorting passage and the lower surface of a transporting belt, and being subject to predetermined processing such as counting, wrapping or the like.

Accordingly, in such a coin processing machine, it is necessary to adjust the spacing between the pair of guide members, namely, the width of the coin sorting passage, so as to coincide with the diameter of the coins to be processed, and to adjust the distance between the upper surface of the coin sorting passage and the lower surface of the transporting belt so as to coincide with the thickness of the coins to be processed. Consequently, the coin processing apparatus generally includes a passage width adjusting means having cams for adjusting the spacing between the pair of guide members, and a transporting belt position adjusting means having cams for adjusting the distance between the upper surface of the coin sorting passage and the lower surface of the transporting belt.

For example, U.S. Pat. No. 4,219,985 discloses a coin processing machine which can adjust the spacing between the pair of guide members to coincide with the diameter of the coins to be processed and to adjust the distance between the lower surface of the transporting belt and the upper surface of the coin sorting passage to coincide with the thickness of the coins to be processed by operating dials in accordance with the denomination of the coins to be processed. Japanese patent application laid open No. 59-84721 discloses a coin processing machine constituted so that when buttons are operated in accordance with the denomination of the coin to be processed, cams are rotated to adjust the spacing between the pair of guide members so as to coincide with the diameter of the coins to be processed and to adjust the distance between the lower surface of the transporting belt and the upper surface of the coin sorting passage to coincide with the thickness of the coins to be processed.

However, in the thus constituted coin processing machines, the cams are rotated in accordance with the denomination of the coin to be processed to adjust the spacing between the pair of guide members to coincide with the diameter of the coins to be processed and to adjust the distance between the lower surface of the transporting belt and the upper surface of the coin sorting passage to coincide with the thickness of the coins to be processed. Consequently, if new coins of different diameter and thickness are issued or if a coin processing machine which is constituted such that the spacing between the pair of guide members and the distance between the lower surface of the transporting belt and the upper surface of the coin sorting passage are set so as to accept the coins currently in circulation in a particular country and process them is used in another country, the mechanical arrangement of the machine has to be changed in order to make the spacing between the pair of guide members and the distance between the lower surface of the transporting belt and the upper surface of the coin sorting passage coincide with the diameter and thickness of the coins which are newly issued or are used in the other country. However, such mechanical changes are quite troublesome, and therefore, a restriction is imposed on the utility of the coin processing machine.

SUMMARY OF THE INVENTION

It is therefore an object of the present invention to provide a coin processing machine which comprises a rotatable disk for receiving deposited coins and feeding out the received coins to a coin sorting passage by a centrifugal force produced by rotation thereof, the coin sorting passage having a pair of guide members. Denomination setting means selects the denomination of coins to be processed, and coin processing means processes the coins which are fed out to the coin sorting passage in accordance with the denomination selected by the denomination setting means. Thus, coins of any diameter and thickness can be processed without changing the mechanical arrangement thereof.

The above and other objects of the present invention can be accomplished by a coin processing machine comprising a rotatable disk for receiving deposited coins and feeding out the received coins to a coin sorting passage by a centrifugal force produced by rotation thereof, the coin sorting passage having a pair of guide members. Denomination setting means selects the denomination of coins to be processed, and coin processing means processes the coins which are fed out to the coin sorting passage in accordance with the denomination selected by the denomination setting means. The coin processing machine comprises data storing means for storing coin data concerning the denomination of coins to be processed, data input means for inputting the coin data into the data storing means, and control means for reading out the coin data from the data storing means in accordance with the denomination selected by the denomination setting means so as to control the coin processing means.

In a preferred aspect of the present invention, the data storing means includes a first data storing means for storing coin data stored in advance, the coin data being adapted to be read from the first data storing means, and a second data storing means for storing coin data newly stored by the data input means, the coin data being adapted to be written in and read from the second data storing means.

In another preferred aspect of the present invention, the data input means includes keyboard means having a plurality of keys, the data input means being activated by the operation of predetermined keys, whereby the coin data are input to the second data storing means.

In a further preferred aspect of the present invention, the coin data include denomination data and each of the denomination data being assigned to a predetermined number.

When the denomination setting means selects one of the predetermined numbers, the control means reads out the coin data from the data storing means in accordance with the one of the predetermined numbers selected by the denomination setting means.

In a still further preferred aspect of the present invention, the coin processing machine further comprises passage width adjusting means for adjusting a spacing between the pair of guide members, transporting belt means for holding the coins in the coin sorting passage between a lower surface thereof and an upper surface of the coin sorting passage and for transporting the coins, and transporting belt position adjusting means for adjusting a vertical position of the transporting belt means. The coin data includes coin diameter data and coin thickness data. The control means read out from the data storing means the coin diameter data and the coin thickness data of the denomination of the coins to be processed in accordance with the denomination selected by the denomination setting means and outputs the coin diameter data and the coin thickness data so as to adjust the spacing between the pair of guide members and to adjust the vertical position of the transporting belt means.

In a yet further preferred aspect of the present invention, the coin processing means includes coin stacking means for stacking coins to be wrapped after passing through the coin sorting passage. Coin support post means receives coins stacked in the coin stacking means at a post waiting position immediately below the coin stacking means and supports them on the upper surface thereof. Coin wrapping means includes a plurality of wrapping rollers for winding a wrapping film around the stacked coins supported by the coin support post means to wrap them and produce a wrapped coin roll. Support post moving means moves the coin support post means between the post waiting position immediately below the coin stacking means, a post wrapping position where the coins supported on the upper surface of the coin support post means can be wrapped by the coin wrapping means, and a post retracted position where the coin support post means is retracted from between the plurality of wrapping rollers. First wrapping roller moving means moves the plurality of wrapping rollers between wrapping roller wrapping positions where the coins are wrapped and wrapping roller waiting positions where the plurality of wrapping rollers are slightly more apart from each other than in the wrapping roller wrapping positions. The coin data includes coin thickness data, wherein the support post moving means lowers the coin support post means by a distance substantially corresponding to the thickness of one coin based on the coin thickness data of the coins to be wrapped which are read out from said data storing means by said control means each time the coin support post means receives one coin during the period between the time that the coin stacking means stacks coins in a number that is smaller than a predetermined number and the coin support post means receives the coins stacked from the coin stacking means and the time that the coin support post means supports the coins in the predetermined number to be wrapped.

In a further preferred aspect of the present invention, the coin data includes reference wrapping unit number data indicating the number of coins to be wrapped in one wrapped coin roll, and said predetermined number is determined based upon said reference wrapping unit number data.

In a still further preferred aspect of the present invention, the support post moving means lowers the coin support post means by a distance substantially corresponding to the thickness of one coin each time the coin support post means receives a coin during a period between the time that the coin support post means first receives the coins stacked in the coin stacking means and the time that the coin support post means receives the coins in a predetermined number to be wrapped in one wrapped coin roll on the upper surface thereof and after the coin support post means supports the coins in a number equal to the predetermined number to be wrapped in one wrapped coin roll on the upper surface thereof. The support post moving means lowers the coin support post means to the post wrapping position where the stacked coins supported thereby can be wrapped.

In a yet further preferred aspect of the present invention, the first wrapping roller moving means moves the plurality of wrapping rollers only by a distance between the wrapping roller wrapping positions and the wrapping roller waiting positions. Second wrapping roller moving means moves the plurality of wrapping rollers by a distance between the wrapping roller wrapping positions and wrapping roller retracted positions where the wrapping rollers are more apart from each other than in the wrapping roller waiting positions. The support post moving means moves the coin support post means in synchronism with the movement of the plurality of wrapping rollers by the first wrapping roller moving means.

In a further preferred aspect of the present invention, the coin stacking means further includes a pair of stacking blocks each being movable relative to the other.

In a still further preferred aspect of the present invention, the coin processing machine further comprises shutter means which can be opened and closed at a bottom portion of the coin stacking means. When coins are to be wrapped, the shutter means is closed, the plurality of wrapping rollers are moved to the predetermined wrapping roller waiting positions by the first wrapping roller moving means and/or the second wrapping roller moving means, the width of the coin sorting passage is adjusted by the passage width adjusting means in accordance with the denomination selected by the denomination setting means, and the coin support post means is moved to the post waiting position immediately below the shutter means, before the coins stacked in the coin stacking means are transferred to the coin support post means.

The above and other objects and features of the present invention will become apparent from the following description made with reference to the accompanying drawings.

BRIEF DESCRIPTION OF THE DRAWINGS

FIGS. 13A and 13B are tables showing coin data stored in a ROM and a RAM.

DESCRIPTION OF THE PREFERRED EMBODIMENTS

Figure 1:
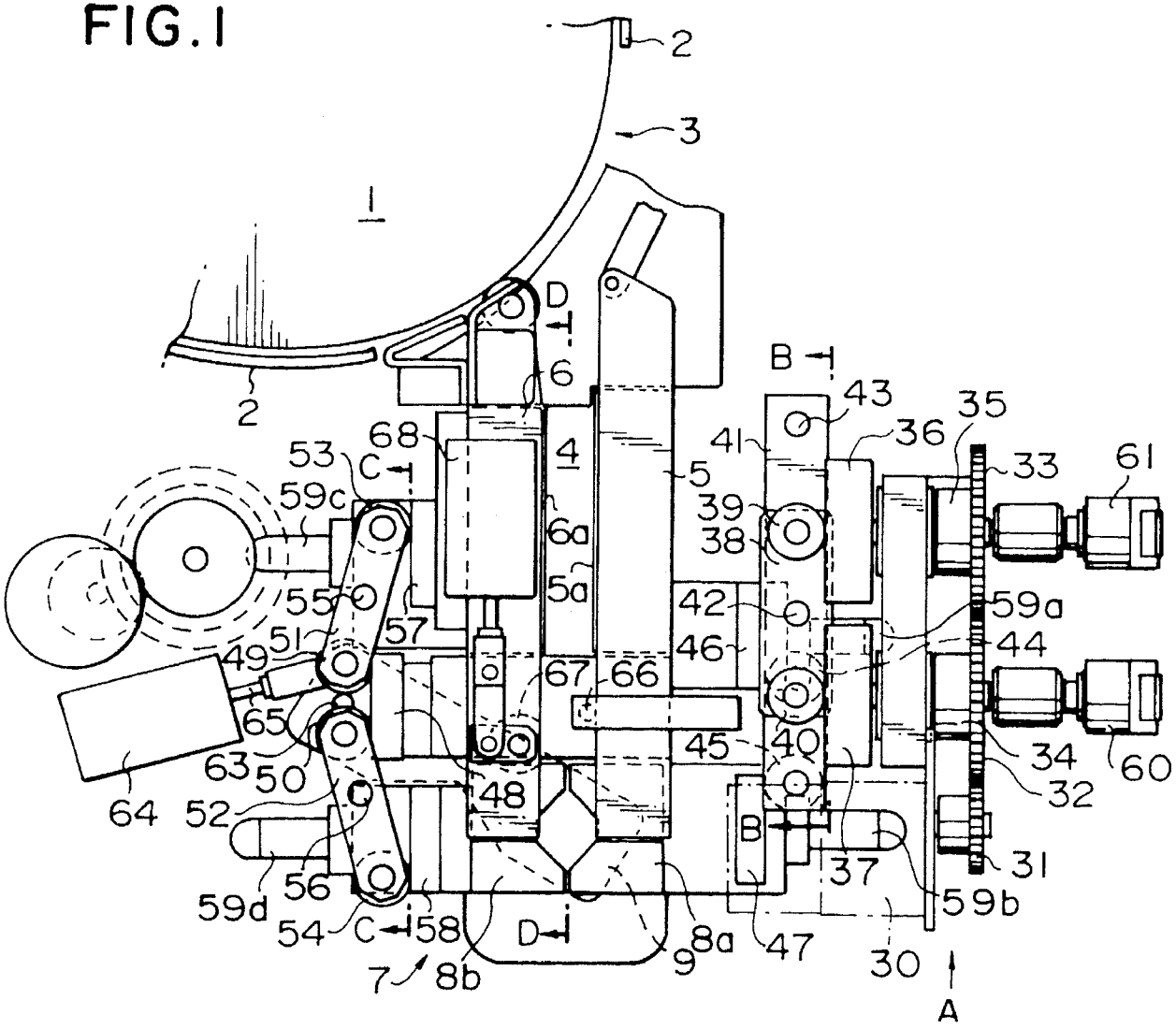
FIG. 1 is a schematic plan view of a coin sorting passage and a coin stacking portion of a coin wrapping machine which is an embodiment of the present invention.

As shown in FIG. 1, a coin wrapping machine which is an embodiment of the present invention is adapted for counting or for counting and wrapping coins of a specific denomination. Coins deposited through a coin depositing section (not shown) into the coin wrapping machine are fed by a transporting belt (not shown) onto a rotatable disk 1. An annular guide member 2 is connected at the circumferential edge portion of the rotatable disk 1 and a coin sorting passage 4 is connected to an opening 3 of the annular guide member 2 in a well known manner.

The coin sorting passage 4 is formed by a pair of guide members 5, 6 and a transporting belt (not shown) described later, and the lower edge portions of the guide members 5, 6 are formed with facing shelf-like coin supporting portions 5*a*, 6*a* for supporting coins to be counted or to be counted and wrapped on the upper surfaces thereof. The space between the pair of guide members 5, 6 is adjustable by a passage width adjusting motor described later so that only coins to be counted or to be counted and wrapped are supported by the coin supporting portions 5*a*, 5*b* to pass through the coin sorting passage 4. Coins larger than the coins to be counted or to be counted and wrapped remain on the rotatable disk 1 while coins smaller than those to be counted fall through the space between the pair of guide members 5, 6 to be collected.

A coin temporary stacking section 7 is provided downstream of the coin sorting passage 4 and includes a pair of movable stacking blocks 8*a*, 8*b* and a shutter 9 disposed below the pair of stacking blocks 8*a*, 8*b*. When the shutter 9 is opened, the space between the pair of stacking blocks 8*a*, 8*b* opens downward and when the shutter is closed, the pair of stacking blocks 8*a*, 8*b* and the shutter 9 form a stacking section for temporarily stacking coins. The coin temporary stacking section 7 is constituted to form a hexagon when the pair of stacking blocks 8*a*, 8*b* come into abutment. Namely, the facing inner surfaces of the pair of stacking blocks 8*a*, 8*b* each consists of a segment lying at an angle of 45 degrees to the direction of the coin sorting passage 4, a segment parallel to the coin sorting passage 4 and a segment lying at an angle of 135 degrees to the direction of the coin sorting passage 4.

A coin wrapping section to be described later is provided below the shutter 9.

Figure 2:
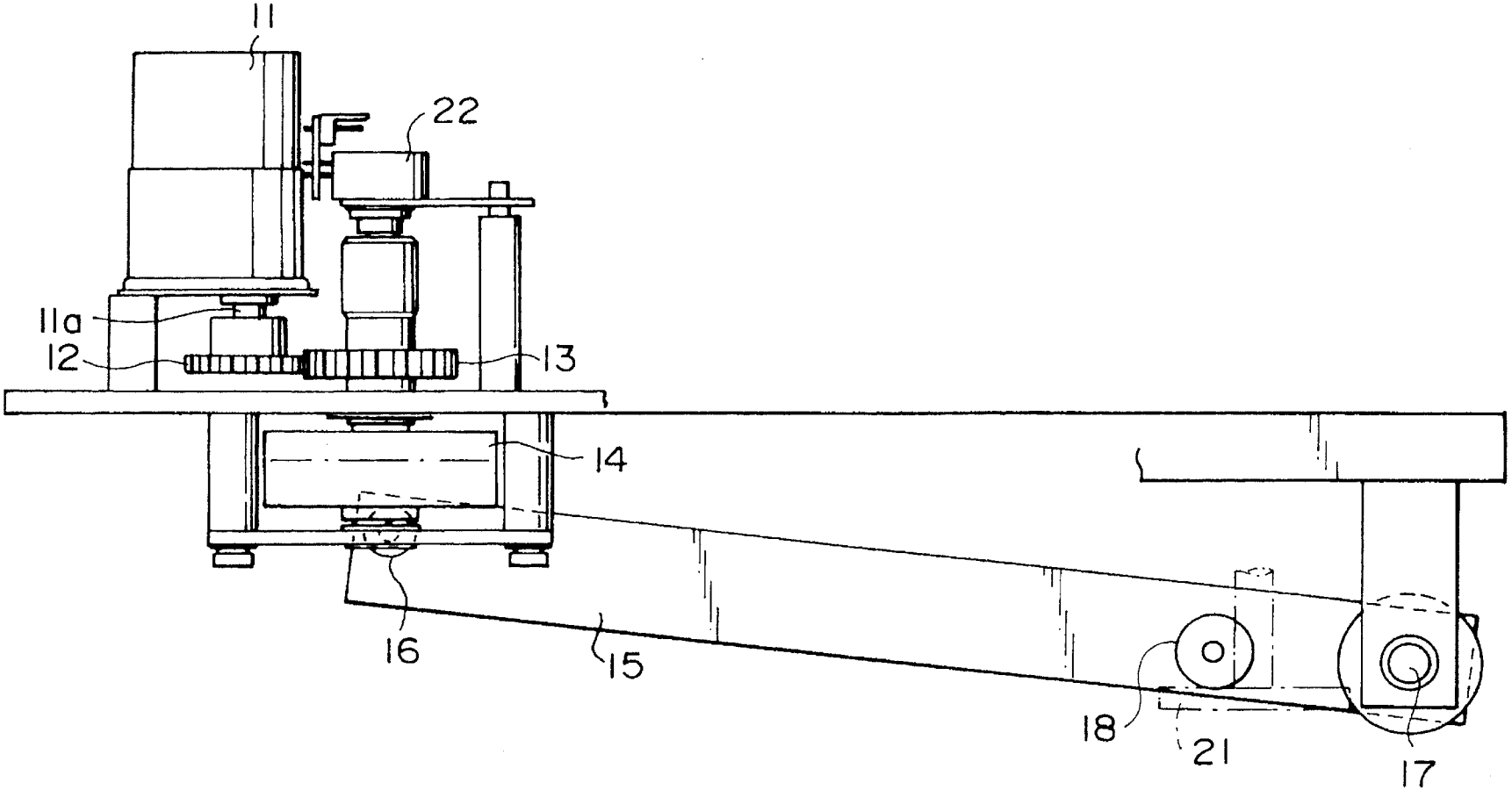
FIG. 2 is a schematic side view showing a transporting belt position adjusting mechanism used in the coin wrapping machine which is an embodiment of the present invention for adjusting the vertical position of a transporting belt.
Figure 3:
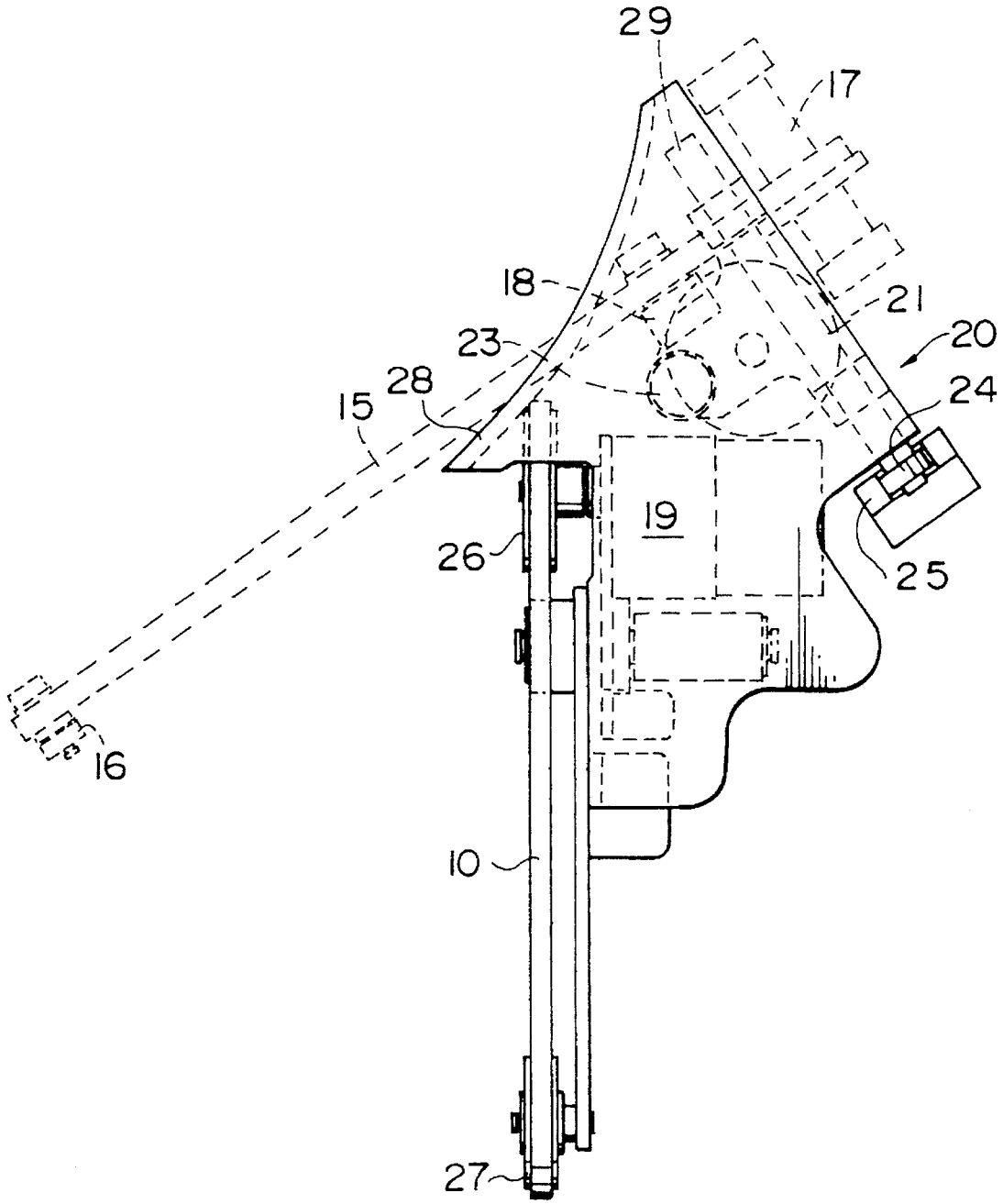
FIG. 3 is a schematic plan view showing a transporting belt position adjusting mechanism used in the coin wrapping machine which is an embodiment of the present invention for adjusting the vertical position of a transporting belt.

FIG. 2 is a schematic side view showing a transporting belt position adjusting mechanism for adjusting the vertical position of a transporting belt 10 forming the coin sorting passage 4 together with the pair of guide members 5, 6 for transporting coins and FIG. 3 is a schematic plan view thereof.

The transporting belt position adjusting mechanism is adapted for adjusting the vertical position of the transporting belt 10 so as to correspond to the thickness of coins to be counted or to be counted and wrapped. As shown in FIG. 2, the transporting belt position adjusting mechanism includes a motor 11 and the output shaft 11*a* of the motor is connected to a gear 12 meshed with a gear 13. A cam 14 is connected to the gear 13 and a cam follower 16 mounted on one end portion of lever 15 abuts against the cam 14. As shown in FIGS. 2 and 3, a shaft 17 fixed to the body of the coin wrapping machine passes through the other end portion of the lever 15 and the lever 15 is swingable about the shaft 17. A roller 18 is secured to the lever 15 in the vicinity of the shaft 17 and a circular connecting plate 21 abuts on the lower surface of the roller 18. The circular connecting plate 21 is integrally formed with a transporting belt unit 20 including the transporting belt 10 and a motor 19 for driving the transporting belt 10. Consequently, when the motor 11 is driven, the driving force of the motor 11 is transmitted to the cam via the output shaft 11*a*, the gear 12 and the gear 13, whereby the cam 14 is rotated and the cam follower 16 is moved vertically by the lobe of the cam 14. As a result, the lever 15 is swung about the shaft 17 and the connecting plate 21 is moved vertically by the roller 18, whereby the vertical position of the transporting belt unit 20 integrally formed with the connecting plate 21, and, therefore, that of the transporting belt 10 are adjusted. A rotary encoder 22 is connected to the gear 13 and is adapted for detecting the amount of rotation of the gear 13, namely, the vertical position of the transporting belt 10. In FIG. 3, the reference numeral 23 designates a guide pin, the reference numeral 24 designates a roller and the reference numeral 25 designates a slide rail abutting against the roller 24. These members support the transporting belt unit 20 to be vertically movable.

As shown in FIG. 3, the transporting belt 10 is entrained around a drive pulley 26 and a driven pulley 27 and is adapted to hold coins between the lower surface thereof and the coin supporting portions 5*a*, 5*b* and transport them. In FIG. 3, the reference numeral 28 designates a gap regulating member which is disposed at the opening 3 of the annular guide member 2 such that the spacing between itself and the rotatable disk 1 is greater than the thickness of the thickest coin to be counted or to be counted and wrapped and narrower than double the thickness of the thinnest coin to be counted or to be counted and wrapped. As a consequence, when the vertical position of the transporting belt 10 is adjusted by the transporting belt position adjusting mechanism so as to correspond to the thickness of the coins to be counted or to be counted and wrapped, the vertical position of the gap regulating member 28 is simultaneously adjusted so as to prevent two or more coins from being simultaneously fed from the rotatable disk 1 into the coin sorting passage 4. Further, the transporting belt unit 20 includes a support shaft 29 mounted on the body of the coin wrapping machine so as to be vertically movable and can be opened and closed about the support shaft 29. Therefore, if coin jamming or some other trouble occurs, it is possible to remove the jammed coins by opening the transporting belt unit 20 about the support shaft 29.

Figure 4:
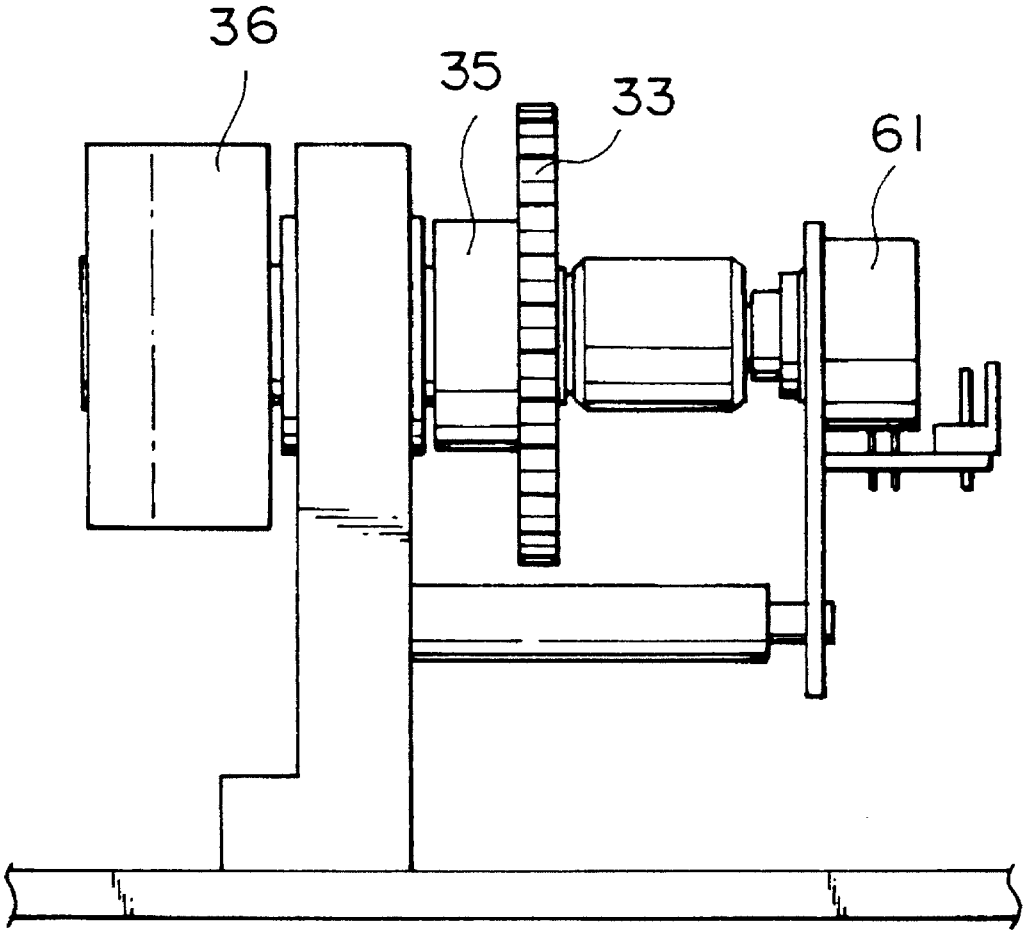
FIG. 4 is a schematic side view in the direction indicated by the arrow A in FIG. 1, showing a passage width adjusting mechanism used in the coin wrapping machine which is an embodiment of the present invention.

FIG. 4 is a schematic side view in the direction indicated by an arrow A in FIG. 1 and shows a passage width adjusting mechanism for adjusting the passage width of the coin sorting passage 4, namely, the spacing between the pair of guide members 5, 6 so as to be suitable for the diameter of the coins to be counted or to be counted and wrapped.

Figure 5:
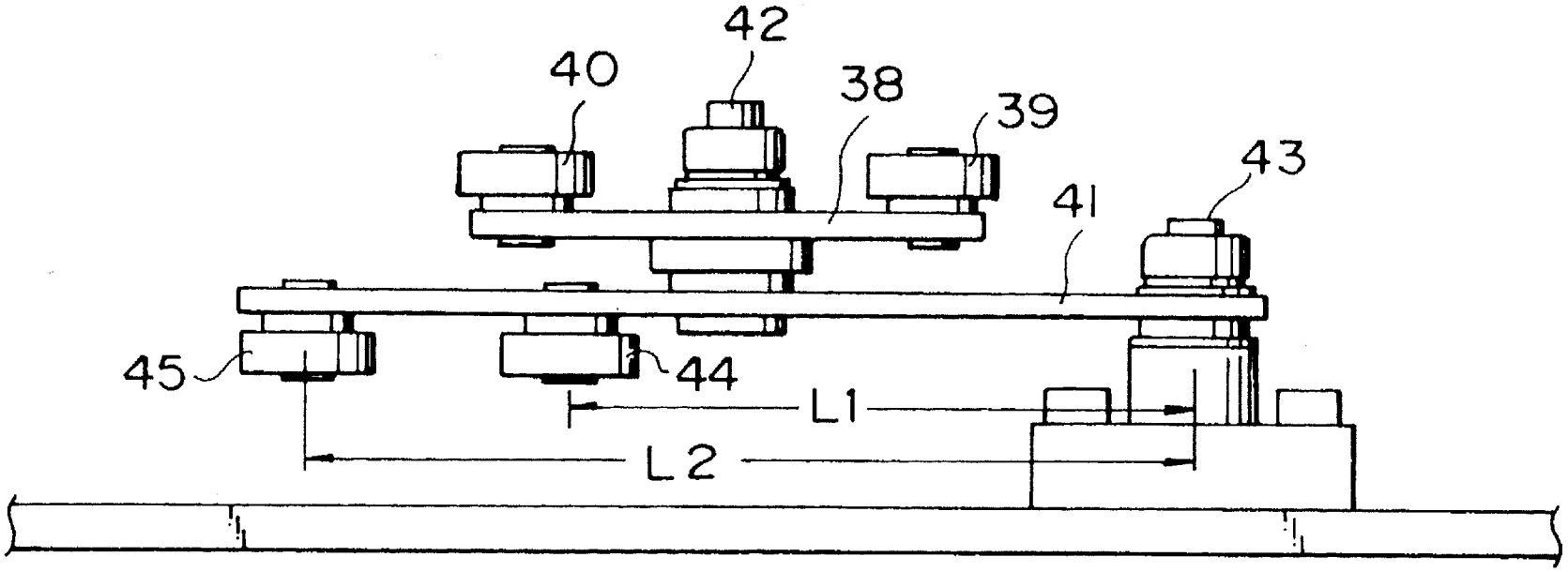
FIG. 5 is a schematic cross sectional view taken along line B—B in FIG. 1.

As shown in FIG. 1, the passage width adjusting mechanism includes a motor 30, and a drive gear 31 connected to the output shaft of the motor 30 and meshing with a gear 32 which meshes with a gear 33. The gears 32, 33 are respectively connected to a rough adjustment cam 37 and a fine adjustment cam 36 via one-way clutches 34, 35. The lobe of the rough adjustment cam 37 is formed to have greater unevenness than that of the fine adjustment cam 36. The cam surfaces of the rough adjustment cam 37 and the fine adjustment cam 36 respectively abut against cam followers 40, 39 mounted in the vicinity of the opposite end portions of an elongated plate 38. As shown in FIG. 5, which is a schematic cross sectional view taken along line B—B in FIG. 1, a swing arm 41 is disposed below the plate 38 and a shaft 42 fixed to the central portion of the swing arm 41 and extends upwardly so as to swingably support the plate 38 at the central portion thereof. The swing arm 41 is swingable about a shaft 43 provided at one end portion thereof. The underside of the swing arm 41 is provided with a first roller 44 spaced from the shaft 43 by the distance L1 and a second roller 45 spaced from the shaft 43 by the distance L2. The ratio of L1 to L2 is 1:2*. The first roller 44 abuts against one side surface of a rectangular parallelepiped-like movable plate 46 formed integrally with the guide member 5 to stand erect thereon. On the other hand, the second roller 45 abuts against a rectangular parallelepiped-like movable plate 47 formed integrally with the stacking block 8*a* to stand erect thereon. The movable plate 46 is biased to the right in FIG. 1 by a spring (not shown) so as to broaden the width of the coin sorting passage 4 and the movable plate 47 is biased to the right in FIG. 1 by a spring (not shown) so as to move the stacking block 8*a* apart from the other stacking block 8*b*.

Figure 6:
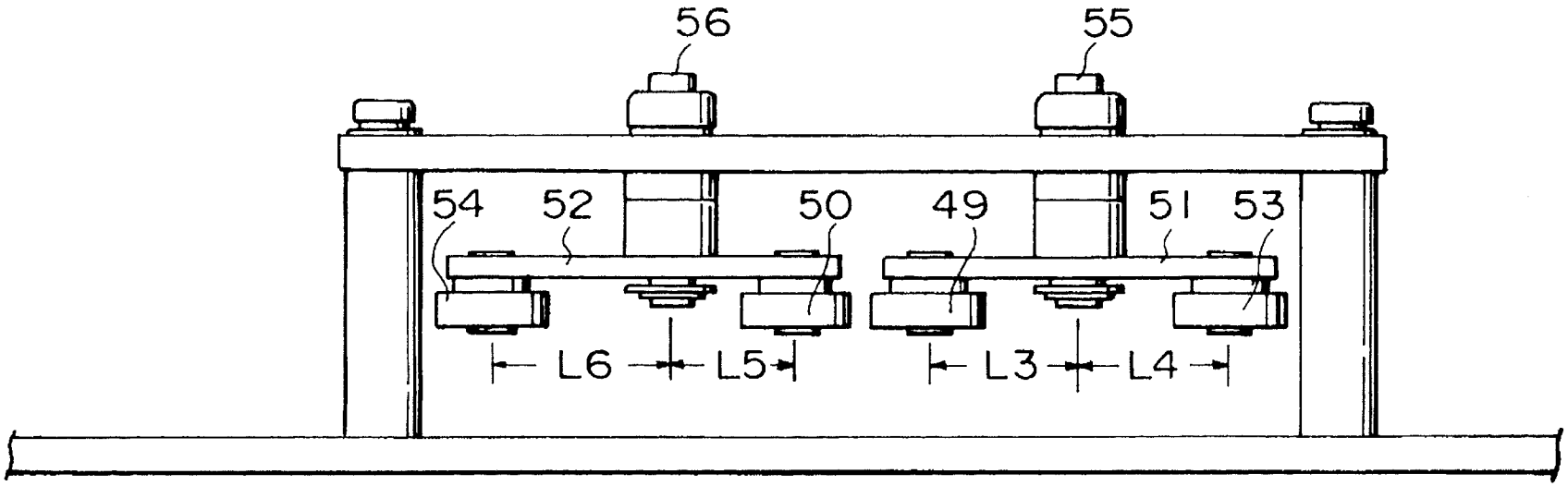
FIG. 6 is a schematic cross sectional view taken along line C—C in FIG. 1.

On the opposite side of the coin sorting passage from the movable plate 46, a rectangular parallelepiped-like movable plate 48 is formed integrally with the guide member 5 to stand erect thereon. The movable plate 48 abuts against a roller 49 and a roller 50. The roller 49 is rotatably mounted in the vicinity of one end portion of a link 51 and the roller 50 is rotatably mounted in the vicinity of one end portion of a link 52. A roller 53 is rotatably mounted in the vicinity of the other end portion of the link 51 and a roller 54 is rotatably mounted in the vicinity of the other end portion of the link 52. As shown in FIG. 6, which is a schematic cross sectional view taken along line C—C in FIG. 1, the link 51 is swingable about a shaft 55 which is spaced apart from the shaft of the roller 49 by the distance L3 and from the shaft of the roller 53 by the distance L4. The link 52 is swingable about a shaft 56 which is spaced from the shaft of the roller 50 by the distance L5 and from the shaft of the roller 54 by the distance L6. L3 is equal to L4 and the ratio of L5 to L6 is set to be 1:2*. The roller 53 abuts against one side surface of a rectangular parallelepiped-like movable plate 57 formed integrally with the guide member 6 to stand erect thereon. The movable plate 57 is biased to the left in FIG. 1 by a spring (not shown) so as to broaden the width of the coin sorting passage 4. The roller 54 abuts against one side surface of a rectangular parallelepiped-like movable plate 58 formed integrally with the other stacking block 8*b* to stand erect thereon at a position relative to the coin temporary stacking section 7 corresponding to that of the movable plate 47 of the stacking block 8*a*. The movable plate 58 is biased to the left in FIG. 1 by a spring (not shown) so as to move the stacking block 8*a* apart from the other stacking block 8*b*. In FIG. 1, the reference numerals 59a, 59b, 59c and 59*d* respectively designate slide rails and the reference numerals 60 and 61 designate rotary encoders.

The motor 30 can rotate the drive gear 31 in forward and backward directions by 360 degrees. The one-way clutch 35 transmits the rotating force to the fine adjustment cam 36 only when the gear 33 is rotated, for example, in the forward direction and the one-way clutch 34 transmits the rotating force to the rough adjustment cam 37 only when the gear 32 is rotated, for example, in the forward direction. Therefore, when the drive gear 31 is rotated by the motor 30 in the backward direction, for example, the rotating force of the motor 30 is transmitted to the rough adjustment cam 37 via the gear 32 and the one-way clutch 34. On the other hand, when the drive gear 31 is rotated by the motor 30 in the forward direction, for example, the rotating force of the motor 30 is transmitted to the fine adjustment cam 36 via the gear 32, the gear 33 and the one-way clutch 35.

In the thus constituted passage width adjusting mechanism, prior to a counting operation or counting and wrapping operations for coins of a specified denomination, the width of the coin sorting passage 4 and the diameter of the coin temporary stacking section 7 are adjusted so as to correspond to the diameter of the denomination of the coins to be counted or to be counted and wrapped in the following manner.

At first, the motor 30 rotates the drive gear 31 in the backward direction by a predetermined angle, thereby rotating the rough adjustment cam 37 in the forward direction via the gear 32. Although the gear 33 is also rotated, since the one-way clutch 35 is interposed between the fine adjustment cam 36 and the gear 33, the fine adjustment cam 36 is not rotated. When the operation is started, the width of the coin sorting passage 4, namely, the spacing between the pair of guide members 5, 6 is set to be maximum and, as a result, the cam follower 40 which abuts against the rough adjustment cam 37 formed with the lobe having greater unevenness is rotated and pressed to the left in FIG. 1, whereby the elongated plate 38 is swung about the shaft 42. Since the shaft 42 is fixed to the swing arm 41 and the cam follower 39 abuts against the fine adjustment cam 36 and is prevented from moving to the right in FIG. 1, the swing arm 41 is swung about the shaft 43 clockwise in FIG. 1, whereby the first roller 44 mounted on the swing arm 41 pushes the movable plate 46 to the left in FIG. 1 and the second roller 45 pushes the movable plate 47 to the left in FIG. 1. As a result, the guide member 5 integrally formed with the movable plate 46 is moved to the left in FIG. 1 against the force of a spring (not shown) and the stacking block 8*a* integrally formed with the movable plate 47 is moved to the left in FIG. 1 against the force of a spring (not shown). At the same time, similarly to the movable plate 46, the movable plate 48 integrally formed with the guide member 5 is moved to the left in FIG. 1 and the roller 49 and the roller 50 which abut against the movable plate 48 are pushed by the movable plate 48 so that the link 51 is swung about the shaft 55 clockwise in FIG. 1 and that the link 52 is swung about the shaft 56 counterclockwise in FIG. 1. Consequently, the roller 53 pushes the movable plate 57 and the roller 54 pushes the movable plate 58 to the right in FIG. 1, whereby the guide member 6 integrally formed with the movable plate 57 and the stacking block 8*b* integrally formed with the movable plate 58 are moved to the right in FIG. 1. Since, as explained above, the ratio of the distance L1 between the shaft of the first roller 44 and the shaft 43 to the distance L2 between the shaft of the second roller 45 and the shaft 43 is set to be 1:2$^{\frac{1}{2}}$, the ratio of the moving distance of the movable plate 46 and accordingly the guide member 5 to the moving distance of the movable plate 47 and accordingly the stacking block 8*a* is equal to 1:2$^{\frac{1}{2}}$. On the contrary, since the distance L3 between the shaft of the roller 49 and the shaft 55 and the distance L4 between the shaft of the roller 53 and the shaft 55 are equal, the moving distance of the movable plate 57 caused by the movement of the movable plate 48 integrally formed with the movable plate 46 is equal to the moving distance of the movable plate 46 and, therefore, the moving distance of the guide member 6 is equal to the moving distance of the guide member 5. On the other hand, since the ratio of the distance L5 between the shaft of the roller 50 and the shaft 56 to the distance L6 between the shaft of the roller 54 and the shaft 56 is set to be 1:2$^{\frac{1}{2}}$, the ratio of the moving distance of the movable plate 48, namely, the moving distance of the movable plate 57 to the moving distance of the movable plate 58 is equal to 1:2$^{\frac{1}{2}}$ and the ratio of the moving distance of the guide member 6 to the moving distance of the stacking block 8*b* is also equal to 1:2$^{\frac{1}{2}}$.

After the rough adjustment cam 37 has been rotated to move the guide members 5, 6 and the stacking blocks 8*a*, 8*b* toward each other by a relatively great distance, the motor 30 rotates the drive gear 31 in the forward direction. Since the one-way clutch 34 is interposed between the gear 32 and the rough adjustment cam 37, the driving force of the motor 30 is no longer transmitted to the rough adjustment cam 37, while, on the other hand, the fine adjustment cam 36 is rotated in the forward direction via the gear 32, the gear 33 and the one-way clutch 35. As described above, the cam follower 39 mounted on the plate 38 abuts on the fine adjustment cam 36 and is pushed to the left in FIG. 1 while it is being rotated, whereby the plate 38 is swung about the shaft 42. Since the shaft 42 is fixed to the swing arm 41 and the rough adjustment cam 37 abuts against the cam follower 40 and is prevented from moving to the right in FIG. 1, the swing arm 41 is swung about the shaft 42 clockwise in FIG. 1 so that the guide members 5, 6 and the stacking blocks 8*a*, 8*b* are moved closer to each other. Since the lobe of the fine adjustment cam 36 has smaller unevenness than that of the rough adjustment cam 37, it is possible to adjust the spacing between the guide members 5, 6 and the spacing between the stacking blocks 8*a*, 8*b* to predetermined values by first rotating the rough adjustment cam 37, thereby moving the guide members 5, 6 and the stacking blocks 8*a*, 8*b* toward each other by a relatively great distance and then rotating the fine adjustment cam 36 for thereby moving the guide members 5, 6 and the stacking blocks 8*a*, 8*b* toward each other little by little. The reason why the guide members 5, 6 and the stacking blocks 8*a*, 8*b* are moved so that the ratio of their moving distances is always equal to 1:2$^{\frac{1}{2}}$ is that since the pair of stacking blocks 8*a*, 8*b* can be moved only in parallel to the guide members 5, 6 and that as described above, the coin temporary stacking section 7 forms a hexagon when the stacking blocks 8*a*, 8*b* abut against each other, even when the stacking blocks 8*a*, 8*b* do not abut against each other, coins temporarily stacked in the coin temporary stacking section 7 can be guided by four points of the inner wall surfaces of the stacking blocks 8*a*, 8*b* with a spacing, for example, 1mm, from each inner wall surface.

In this embodiment, the circumferences of the fine adjustment cam 36 and the rough adjustment cam 37 are each divided into sixteen sections. Thirteen of the sixteen sections of the fine adjustment cam 36 are used and the guide members 5, 6 are moved in increments of 0.1 mm. Fifteen of the sixteen sections of the rough adjustment cam 37 are used and the guide members 5, 6 are moved in increments of 1.3 mm. It is therefore possible to move the guide members 5, 6 through 15×13=195 stages, namely, 15 mm to 34 mm.

The shutter 9 forming the bottom portion of the coin temporary stacking section 7 has a substantially rectangular lateral cross section and is supported by a shaft 63 fixed to the body of the coin wrapping machine at a point on its longitudinal axis in the vicinity of the edge portion on the side opposite from the coin temporary stacking section 7. An arm 65 of a shutter solenoid 64 is attached to the shutter 9 at a point offset from its longitudinal axis in the vicinity of the edge portion on the side opposite from the coin temporary stacking section 7. As a consequence, when the shutter solenoid 64 is driven, the shutter 9 is swung about the shaft 63 and is advanced to or retracted from the portion below the space between the stacking blocks 8*a*, 8*b*.

A sensor 66 for detecting coins is provided upstream of the coin temporary stacking section 7 in the coin sorting passage 4 and the detection signals thereof are input to a central processing unit; CPU (not shown).

A stopper 67 provided downstream of the sensor 66 is adapted to project into the coin sorting passage 4 for preventing coins from being fed to the coin temporary stacking section 7. The stopper 67 has a shape obtained by cutting a cylinder along its axis and removing the part on one side of the cut. It can be rotated by a stopper solenoid 68. The stopper 67 is constituted such that when it is positioned so that the cut side surface thereof faces the coin sorting passage 4, the side surface is flush with the side surface of the guide member 6 on the side of the coin sorting passage 4 and when the stopper 67 is rotated, the side surface of the cylinder projects into the coin sorting passage 4 to prevent coins from being transported further.

Figure 7:
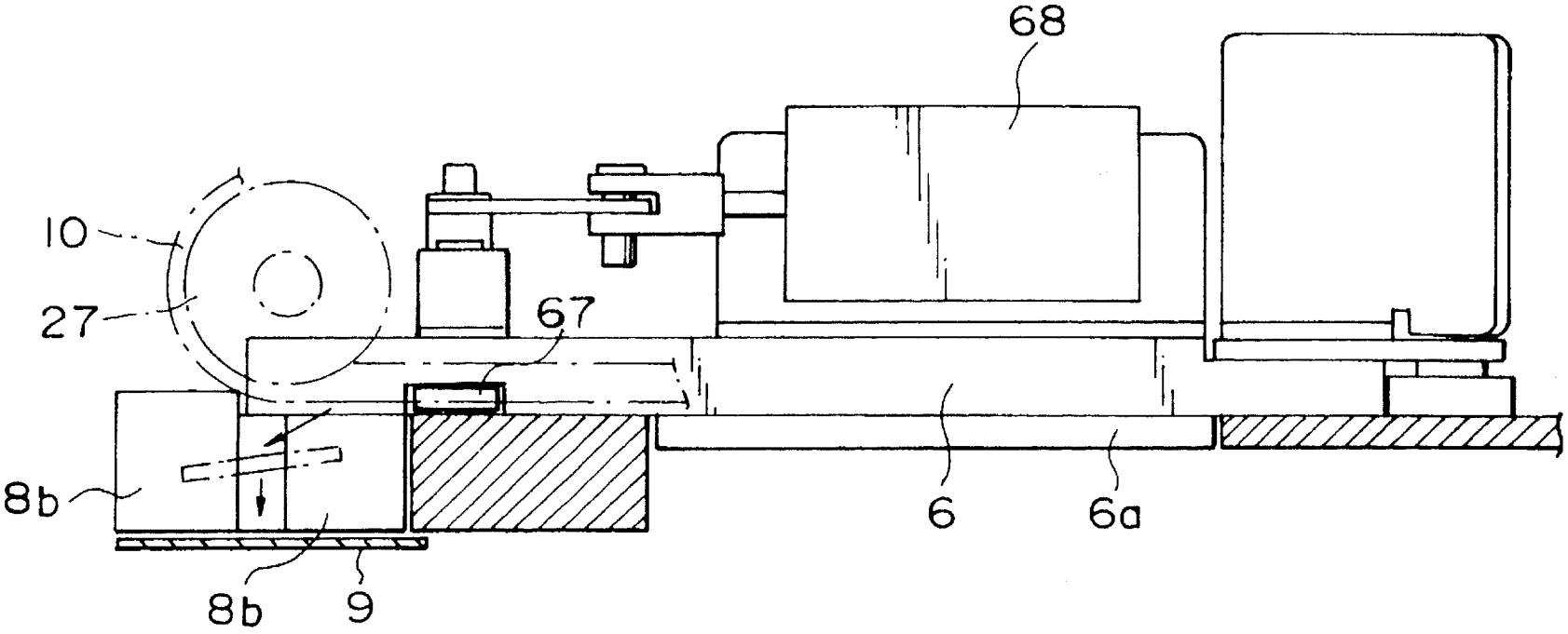
FIG. 7 is a schematic cross sectional view taken along line D—D in FIG. 1.

FIG. 7 is a schematic cross sectional view taken along line D—D in FIG. 1. As shown in FIG. 7, the stacking block 8*b* is formed such that its downstream portion is higher than its upstream portion. As the stacking block 8*a*is formed similarly, coins fed from the coin sorting passage 4 collide with the inner walls of the downstream portions of the stacking blocks 8*a*, 8*b*.

Figure 8:
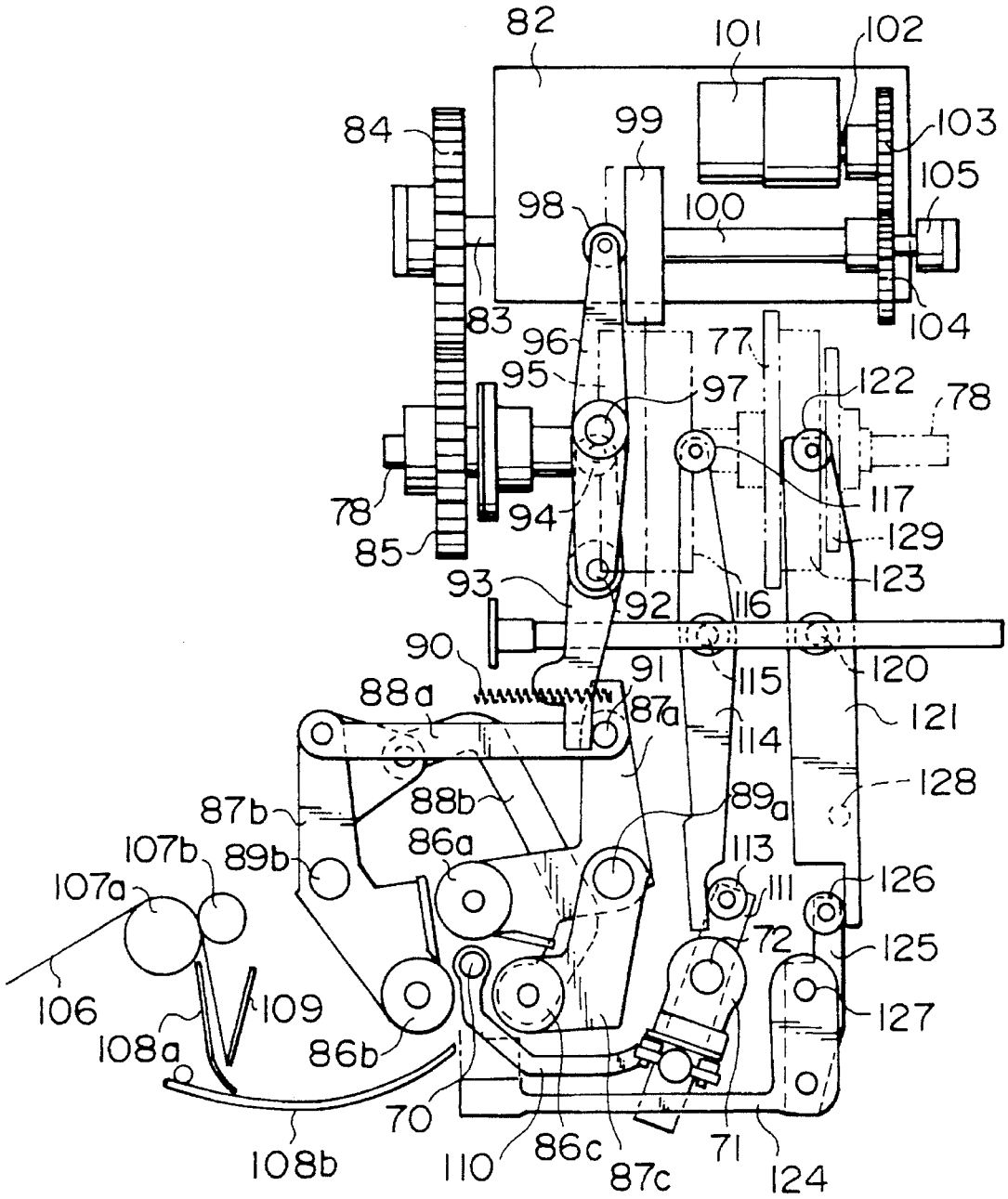
FIG. 8 is a schematic plan view showing a coin wrapping portion.

FIG. 8 is a schematic plan view of the coin wrapping section.

As shown in FIG. 8, the coin wrapping section includes a coin support post 70 for receiving coins from the coin temporary stacking section 7 and supporting them on the upper surface thereof. The coin support post 70 can be moved vertically by a post vertical moving mechanism (not shown in detail in FIG. 8) between a post waiting position immediately below the shutter 9 and a post wrapping position where coins are wrapped. More specifically, when a predetermined number of coins have been stacked in the coin temporary stacking section 7, the shutter 9 is driven to be opened, whereby the stacked coins are received by the upper surface of the coin support post 70 positioned immediately below the shutter 9. After the coin support post 70 has received a predetermined number of the stacked coins in this manner, it is thereafter lowered by a distance corresponding to the thickness of a single coin each time a new coin is fed to the coin temporary stacking section 7 and is stacked on the uppermost coin among the stacked coins supported on the coin support post 70. This lowering operation is conducted by the post vertical moving mechanism and a step motor described later. When a predetermined number of coins have been stacked on the upper surface of the coin support post 70, the coin support post 70 is lowered to the position where the coins are wrapped.

Figure 9:
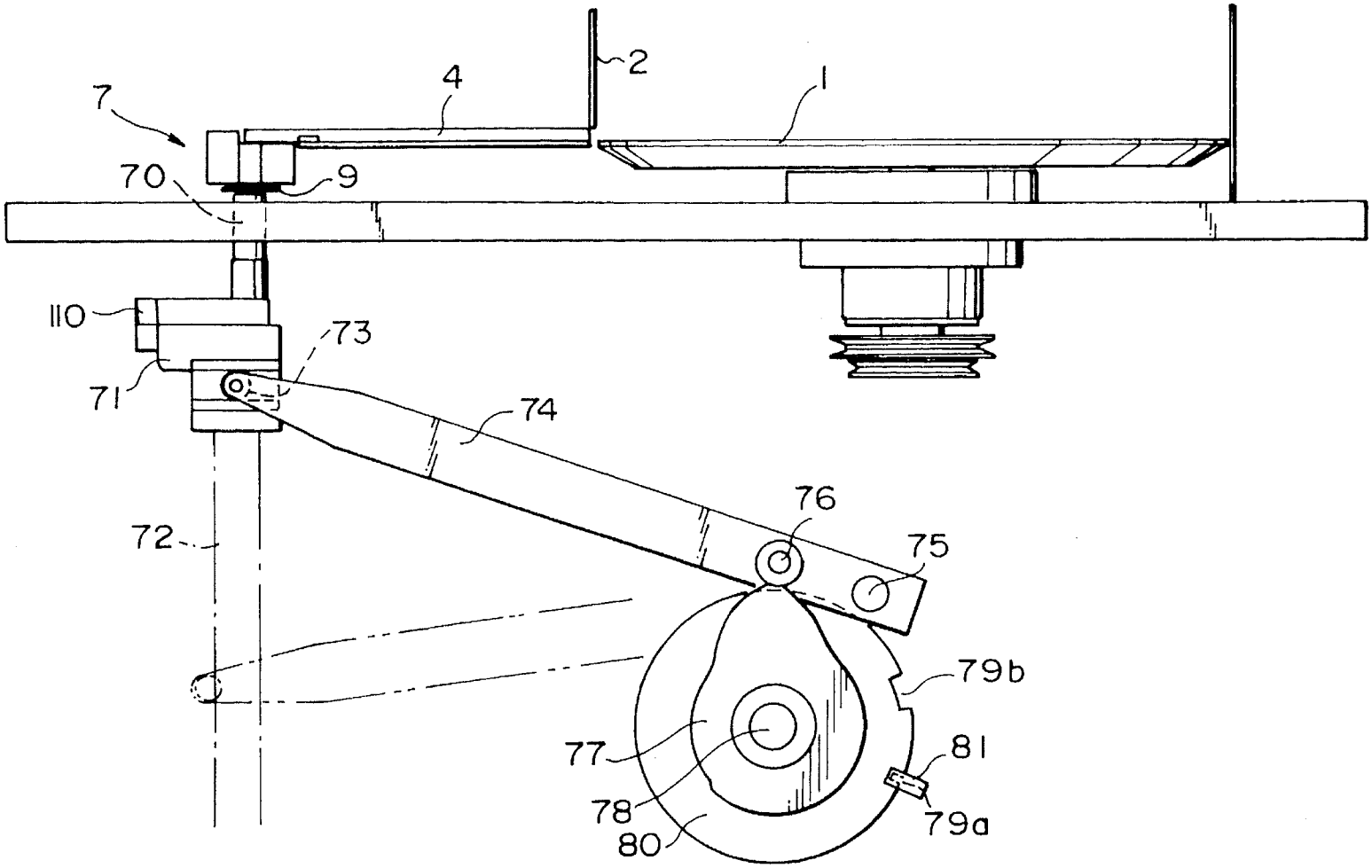
FIG. 9 is a schematic side view showing a post vertical moving mechanism.

FIG. 9 is a schematic side view of the coin vertical moving mechanism.

As shown in FIG. 9, the coin support post 70 is fixed to a post support block 71 via an arm 110 integrally formed therewith and the post support block 71 is supported by a support shaft 72 to be movable vertically. A roller 73 supported by one end portion of an arm 74 is inserted into a groove (not shown) formed in the post support block 71 and the other end portion of the arm 74 is mounted on a shaft 75 fixed to the body of the coin wrapping machine so as to be swingable about the shaft 75. A cam follower 76 is mounted on a portion of the arm 74 in the vicinity of the shaft 75 and abuts against the cam surface of a post elevating and lowering cam 77. The post elevating and lowering cam 77 is fixed to a cam shaft 78 and when the cam shaft 78 is rotated, the post elevating and lowering cam 77 is synchronously rotated, thereby moving the cam follower 76 in accordance with the lobe thereof. As a result, the arm 74 is swung about the shaft 75 and the post support block 71 is moved vertically along the support shaft 72 vertically, whereby the coin support post 70 is moved vertically. A disk 80 whose periphery is formed with two cut portions 79*a*, 79*b* is fixed to the cam shaft 78. A photosensor 81 detects the smaller cut portion 79*a* when the coin support post 70 is positioned immediately below the shutter 9 and detects the larger cut portion 79*b* when the coin support post 70 is retracted from between three wrapping rollers (not shown) to a post retracted position, as described later.

As shown in FIG. 8, a gear 84 is fixed to the output shaft 83 of the step motor 82 and the cam shaft 78 is fixed to a gear 85 meshing with the gear 84.

In FIG. 8, the reference numerals 86*a*, 86*b*, 86*c* designate wrapping rollers which are mounted on one end portions of arms 87*a*, 87*b*, 87*c* respectively. Portions of the arms 87*a*, 87*b* in the vicinity of the other end portions thereof are connected to each other by a link 88*a* and a portion of the arm 87*c* in the vicinity of the wrapping roller 86*c* is connected to a portion of the arm 87*b* in the vicinity of the other end portion thereof by a link 88*b*. The other end portion of the arm 87*c* is connected to a curved portion of the arm 87*a*, which is shaped like a reverse L. The arms 87*a*, 87*c* are swingable about a shaft 89*a* and the arm 87*b* is swingable about a shaft 89*b*. A tension spring 90 is mounted on the other end portion of the arm 87*a* to bias the other end portion of the arm 87*a* to the left in FIG. 8. Further, a pin 91 is secured to a connected portion of the arm 87*a* and the link 88*a* and abuts against one end portion of an arm 93 fixed to a movable shaft 92. A cam follower 94 is mounted on the other end portion of the arm 93 and abuts against a first wrapping roller position adjusting cam 95 for moving the wrapping rollers 86*a*, 86*b*, 86*c* from wrapping roller waiting positions determined in accordance with the denomination of the coins to be wrapped to wrapping roller wrapping positions where the wrapping rollers 86*a*, 86*b*, 86*c* are moved close to each other to hold coins therebetween for wrapping them. The movable shaft 92 is inserted into one end portion of an arm 96 disposed above the arm 93. The arm 96 is mounted on a support shaft 97 so as to be swingable thereabout at substantially its central portion and a cam follower 98 is mounted on the other end portion of the arm 96. The first wrapping roller position adjusting cam 95 is fixed to the cam shaft 78.

The cam follower 98 abuts against the cam surface of a second wrapping roller position adjusting cam 99 for moving the wrapping rollers 86*a*, 86*b*, 86*c* to the wrapping roller waiting positions determined in accordance with the denomination of the coins to be wrapped when the wrapping mode is selected and to wrapping roller retracted positions which are predetermined irrespective of the denominations of coins to be counted and where the wrapping rollers 86*a*, 86*b*, 86*c* are further apart when the counting mode is selected. The second wrapping roller position adjusting cam 99 is fixed to a cam shaft 100. A gear 104 meshing with a gear 103 fixed to the output shaft 102 of a motor 101 is fixed to the cam shaft 100. In FIG. 8, the reference numeral 105 designates a rotary switch for detecting the spacing between the wrapping rollers 86*a*, 86*b*, 86*c*.

Figure 10:
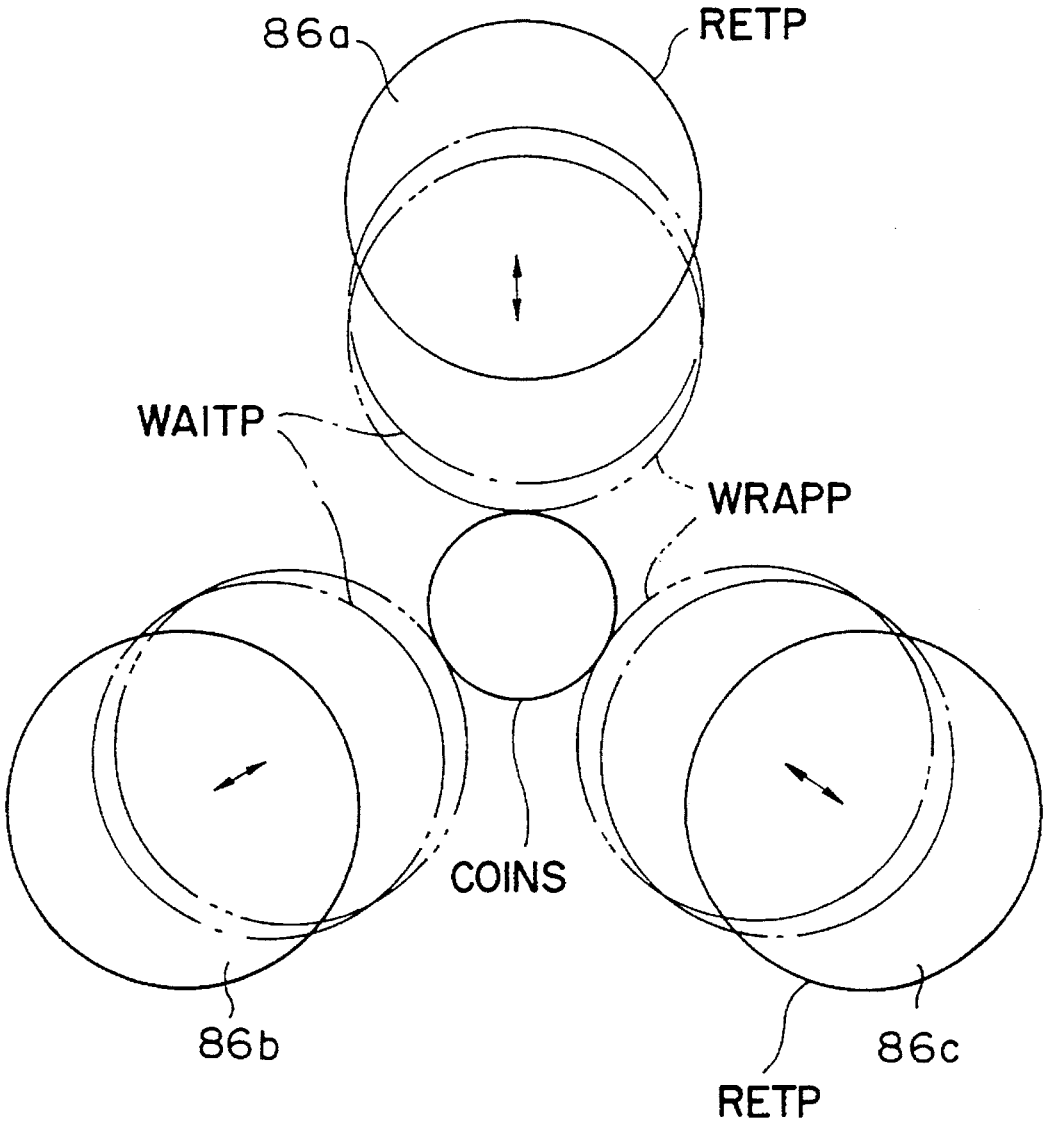
FIG. 10 is a schematic plan view showing the relationship between the wrapping roller wrapping positions, wrapping roller waiting positions and wrapping roller retracted positions of these wrapping rollers.
Figures 11A, 11B, 11C, 11D, 11E:
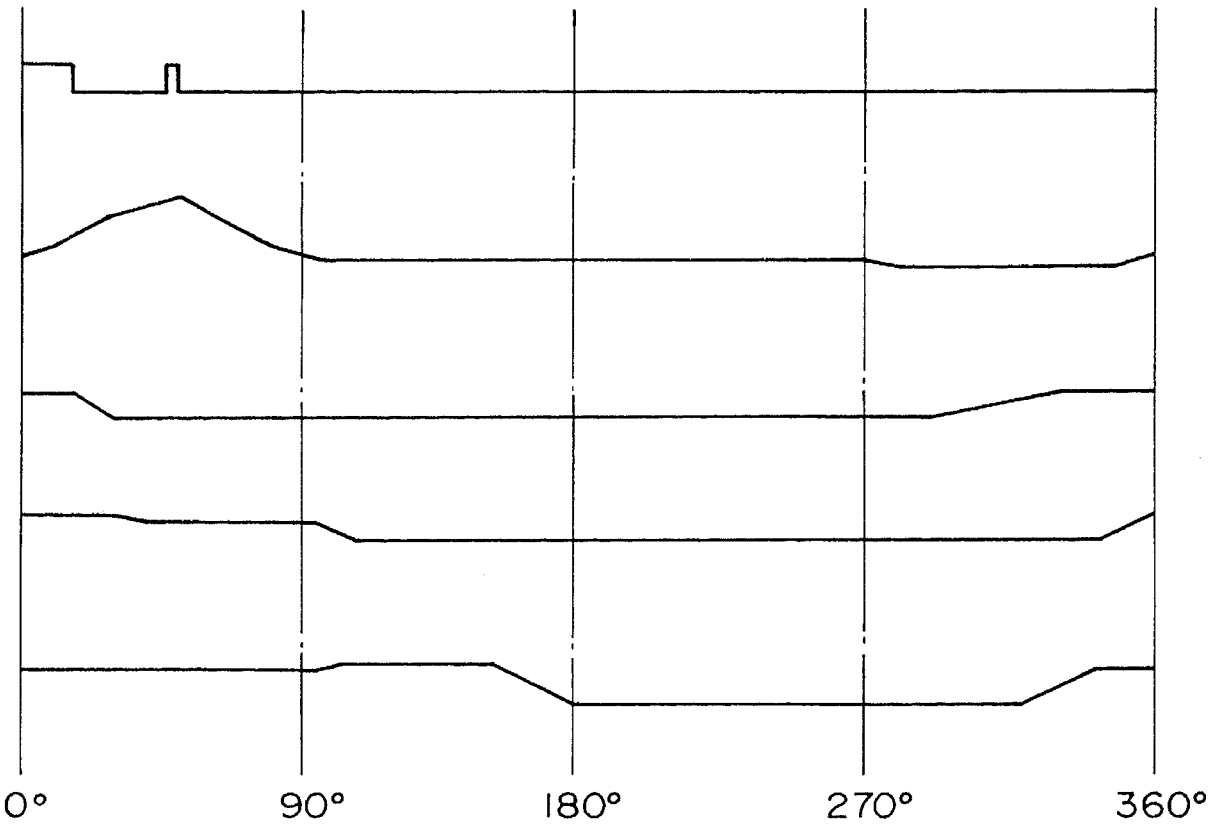
FIGS. 11A to lie are a cam chart of a post elevating and lowering cam, a first wrapping roller position adjusting cam, a post retracting cam and a crimp claw retracting cam during one rotation of a cam shaft.

FIG. 10 is a schematic plan view showing the relationship between wrapping roller wrapping positions WRAPP, wrapping roller waiting positions WAITP and wrapping roller retracted positions RETP of the wrapping rollers 86*a*, 86*b*, 86*c*. In FIG. 10, the distance between the wrapping roller wrapping positions WRAPP and the wrapping roller waiting positions WAITP is constant irrespective of the denomination of the coins to be wrapped. Therefore, the first wrapping roller position adjusting cam 95 is adapted for always moving the wrapping rollers 86*a*, 86*b*, 86*c* toward or away from each other by the distance between the wrapping roller wrapping positions WRAPP and the wrapping roller waiting positions WAITP irrespective of the denominations of the coins to be wrapped. Further, the wrapping roller retracted positions RETP are fixed irrespective of the denominations of coins. However, the wrapping roller waiting positions WAITP are determined in accordance with the coin denominations, namely, the coin diameter. As a consequence, the second wrapping roller position adjusting cam 99 is adapted for moving the wrapping rollers 86*a*, 86*b*, 86*c* toward or away from each other by the distance between the wrapping roller retracted positions RETP and the wrapping roller waiting positions WAITP determined in accordance with the denomination of the coins to be wrapped. Thus, since the wrapping roller waiting positions WAITP differ in accordance with the denominations of the coins to be wrapped, the wrapping roller wrapping positions SRAPP necessarily differ in accordance with the denominations of the coins to be wrapped.

When coins are wrapped, the wrapping rollers 86*a*, 86*b*, 86*c*, which have been located at the wrapping roller waiting positions WAITP determined in accordance with the denomination of the coins wrapped in the previous wrapping operation, are first moved to the wrapping roller waiting positions WAITP determined in accordance with the denomination of the coins to be wrapped in the present wrapping operation. More specifically, the motor 101 is driven and the wrapping rollers 86*a*, 86*b*, 86*c* are moved toward or away from each other so that the spacing between the wrapping rollers 86*a*, 86*b*, 86*c* is greater than the diameter of the coins to be wrapped by a small predetermined distance, whereby they are moved to the wrapping roller waiting positions WAITP. For instance, in the case where the diameter of the coins to be wrapped in the present wrapping operation is greater than that of the coins wrapped in the previous wrapping operation, the motor 101 rotates the gear 103 and the gear 104 via the output shaft 102 thereby rotating the cam shaft 100 and the second wrapping roller position adjusting cam 99. As a result, the cam follower 98 moves to the left in FIG. 8 in accordance with the lobe of the second wrapping roller position adjusting cam 99 and the arm 96 is swung about the support shaft 97 counterclockwise in FIG. 8. Therefore, the movable shaft 92 is moved to the right in FIG. 8 and the arm 93 fixed to the movable shaft 92 moves the pin 91 to the right in FIG. 8 against the force of the tension spring 90. Consequently, the arm 87*a* is swung about the support shaft 89*a* clockwise in FIG. 8 whereby the arm 87*b* is swung clockwise in FIG. 8 via the link 88*a* and the arm 87*c* is swung counterclockwise in FIG. 8 via the link 88*a* and the link 88*b* so that the wrapping rollers 86*a*, 86*b*, 86*c* are moved apart from each other and to the wrapping roller waiting positions WAITP of the denomination of the coins to be wrapped. On the contrary, in the case where the diameter of the coins to be wrapped in the present wrapping operation is smaller than that of the coins wrapped in the previous wrapping operation, the cam follower 98 moves to the right in FIG. 8 and the arm 96 is swung about the support shaft 97 clockwise in FIG. 8, whereby the wrapping rollers 86*a*, 86*b*, 86*c* are moved closer to each other and to the wrapping roller waiting positions WAITP of the denomination of the coins to be wrapped.

On the other hand, since the first wrapping roller position adjusting cam 95 for moving the wrapping rollers 86*a*, 86*b*, 86*c* from the wrapping roller waiting positions WAITP to the wrapping roller wrapping positions WRAPP so as to be close to each other is fixed to the cam shaft 78, it is rotated synchronously with the vertical movement of the coin support post 70. More specifically, after the shutter 9 has been opened and the coin support post 70 has received a predetermined number of stacked coins on the upper surface thereof, the step motor 82 is driven and the cam shaft 78 is rotated via the output shaft 83, the gear 84 and the gear 85 so that the coin support post 70 is lowered by the thickness of one coin each time one coin is fed into the coin temporary stacking section 7 and stacked onto the uppermost coin among the stacked coins supported by the coin support post 70. The profile at the portion of the first wrapping roller position adjusting cam 95 corresponding to this period does not vary but is flat so that the wrapping rollers 86*a*, 86*b*, 86*c* are held at the wrapping roller waiting positions WAITP. The lobe of the first wrapping roller position adjusting cam 95 is determined so that when the coin support post 70 has supported the stacked coin in the number to be wrapped in one wrapped coin roll and has been lowered to the post wrapping position, the wrapping rollers 86*a*, 86*b*, 86*c* are moved to the wrapping roller wrapping position WRAPP where the stacked coins supported by the coin support post 70 can be wrapped. More specifically, the first wrapping roller position adjusting cam 95 is rotated and the cam follower 94 abutting thereagainst at the end portion of the arm 93 is moved to the right in FIG. 8 in accordance with the lobe of the first wrapping roller position adjusting cam 95, whereby the arm 93 is swung about the movable shaft 92 clockwise in FIG. 8. Accordingly, the arm 87*a* biased to the left in FIG. 8 by the tension spring 90 is swung about the support shaft 89*a* counterclockwise in FIG. 8, whereby the arm 87*b* is swung about the support shaft 89*b* counterclockwise in FIG. 8 via the link 88*a*, and the arm 87*c* is swung about the support shaft 89*a* clockwise in FIG. 8 via the link 88*a* and the link 88*b* so that the wrapping rollers 86*a*, 88*b*, 86*c* are moved toward each other.

On the contrary, when coins are counted, the motor 101 is driven so that the wrapping rollers 86*a*, 88*b*, 86*c* are moved apart from each other and are positioned at predetermined wrapping roller retracted positions REPT.

As shown in FIG. 8, a wrapping film feeding mechanism is provided for feeding a wrapping film 106 from a wrapping film roll (not shown) to between the wrapping rollers 86*a*, 88*b*, 86*c*. The wrapping film feeding mechanism includes a pair of film feeding rollers 107*a*, 107*b* for holding the wrapping film 106 therebetween and feeding it, guides 108*a*, 108*b* for guiding the wrapping film 106 along a desired path and a cutter 109 for cutting the wrapping film 106 when a predetermined length of the wrapping film 106 has been fed to between the wrapping rollers 86*a*, 86*b*, 86*c*.

The coin support post 70 is formed integrally with an arm 110 and the arm 110 is fixed to the post support block 71. An arm 111 is fixed to the post support block 71 to be swingable about the support shaft 72 and is always biased counterclockwise in FIG. 8 by a spring (not shown). A roller 113 rotatably mounted on one end portion of the arm 111 abuts against a post retracting arm 114 for retracting the coin support post 70 from between the wrapping rollers 86*a*, 88*b*, 86*c* so that wrapped coins or counted coins can fall between the wrapping rollers 86*a*, 88*b*, 86*c* and be collected after the coin wrapping has been completed or when only the coin counting is effected. The post retracting arm 114 is swingable about a shaft 115 fixed to the body of the coin wrapping machine and a cam follower 117 abutting against the cam surface of a post retracting cam 116 fixed to the cam shaft 78 is rotatably mounted on an end portion of the post retracting arm 114 opposite to the roller 113.

Further, a crimp claw retracting mechanism is provided for retracting a pair of upper and lower crimp claws (not shown) adapted to crimp the upper and lower end portions of the wrapping film 106 which has been wound around the coins to be wrapped from a crimping position where the wrapping film is crimped to crimp claw retracted positions. The crimp claw retracting mechanism includes a crimp claw retracting arm 121 swingable about a shaft 120 fixed to the body of the coin wrapping machine and a cam follower 122 is rotatably mounted on one end portion of the crimp claw retracting arm 121. The cam follower 122 abuts against the cam surface of a crimp claw retracting cam 123 fixed to the cam shaft 78. The other end portion of the crimp claw retracting arm 121 is integrally formed with the crimp claws and abuts against a roller 126 rotatably mounted on one end portion of an arm 125 fixed to an arm 124 extending from the crimp claws. The arm 124 and the arm 125 are swingable about a support shaft 127 and are biased counterclockwise in FIG. 8 about the shaft 127 by a spring (not shown). In FIG. 8, the reference numeral 128 designates a crimp claw actuating stopper for holding the crimp claws at their crimp claw retracted positions when, for instance, the stacked coins are discharged without being wrapped. A crimp claw actuating cam 129 is fixed to the cam shaft 78 for moving the crimp claws vertically and causing them to crimp the upper and lower end portions of the wrapping film 106 wound around the stacked coins. A known mechanism is used as the crimping mechanism for moving the crimp claws and causing them to crimp the upper and lower end portions of the wrapping film 106 and a known mechanism is used as the mechanism for rotating the wrapping rollers 86*a*, 86*b*, 86*c*. Therefore, the description of these mechanism is omitted.

FIGS. 11A to 11E are a cam chart of the post elevating and lowering cam 77, the first wrapping roller position adjusting cam 95, the post retracting cam 116 and the crimp claw retracting cam 123 during one cam shaft rotation.

In FIG. 8, when the long cut portion 79*b* has been detected by the photosensor 81, which is when the coin wrapping has been completed and when only the coin counting is to be effected, the concave cam surface of the post elevating and lowering cam 77 abuts against the cam follower 76 and the convex cam surface of the post retracting cam 116 abuts against the cam follower 117. Further, the convex cam surface of the first wrapping roller position adjusting cam 95 abuts against the cam follower 94 and the convex cam surface of the crimp claw retracting cam 123 abuts against the cam follower 122. Accordingly, since the coin support post 70 and the post support block 71 are located at their lower positions and the post retracting arm 114 has been swung clockwise about the shaft 115, the coin support post 70 is located at the post retracted position where the coin support post is retracted from the space between the wrapping rollers 86*a*, 86*b*, 86*c*. On the other hand, since the arm 93 has been swung counterclockwise about the movable shaft 92, as described above, the spacing between the. wrapping rollers 86*a*, 86*b*, 86*c* is great and the wrapping rollers 86*a*, 86*b*, 86*c* are located at the wrapping roller waiting positions. Further, since the crimp claw retracting arm 121 has been swung clockwise about the support shaft 120, the arm 124 integrally formed with the crimp claws has been swung counterclockwise about the support shaft 127 and the crimp claws are located at the crimp claw retracted position.

As shown in FIG. 11, as the cam shaft 78 is rotated, the portion of the cam profile of the post elevating and lowering cam 77 against which the cam follower 76 abuts becomes convex. Consequently, the coin support post 70 and the post support block 71 are gradually elevated. When the cam shaft 78 has been rotated by 45 degrees and the photosensor 81 has detected the small cut portion 79*a* of the disk 80, the cam follower 76 has come to abutment against the most convex portion of the post elevating and lowering cam 77 and the coin support post 70 and the post support block 71 have been elevated to their uppermost positions. On the other hand, as the cam shaft 78 is further rotated, the portion of the cam profile of the post retracting cam 116 against which the cam follower 117 abuts becomes gradually concave. Consequently, the post retracting arm 114 is swung counterclockwise about the shaft 115 and the coin support post 70 is moved into the space between the wrapping rollers 86*a*, 86*b*, 86*c*. Therefore, when the photosensor 81 detects the small cut portion 79*a* of the disk 80, the coin support post 70 is located at the post waiting position immediately below the shutter 9 in the central portion of the space between the wrapping rollers 86*a*, 86*b*, 86*c*. When the predetermined number of coins have been stacked in the coin temporary stacking section 7 in this state, the shutter solenoid 64 is driven and the shutter 9 is opened, whereby the coins stacked in the coin temporary stacking section 7 are received by the upper surface of the coin support post 70 standing by immediately below the shutter 9.

As the cam shaft 78 is further rotated, the portion of the cam profile of the post elevating and lowering cam 77 against which the cam follower 76 abuts gradually becomes concave so that the coin support post 70 is lowered with the stacked coins supported on the upper surface thereof. On the contrary, the portion of the cam profile of the post retracting cam 116 against which the cam follower 117 abuts becomes flat when the cam shaft 78 has been rotated by about 30 degrees, whereby the coin support post 70 is lowered in the space between the three wrapping rollers 86*a*, 86*b*, 86*c*. The cam shaft 78 is intermittently rotated by the step motor 82 and is controlled so that the coin support post 70 is intermittently lowered in increments equal to the thickness of one coin to be wrapped. When the cam shaft 78 has been rotated by about 100 degrees, the coin support post 70 has reached the post wrapping position where the stacked coins can be wrapped with the predetermined number of the stacked coins supported on the upper surface thereof. Then, the portion of the cam profile of the post elevating and lowering cam 77 against which the cam follower 76 abuts becomes uniform and the coin support post 70 is held at the post wrapping position until the cam shaft has been rotated by about 270 degrees.

On the other hand, the portion of the cam profile of the first wrapping roller position adjusting cam 95 against which the cam follower 94 abuts is uniform during the time that the coin support post 70 is moved from the post waiting position immediately below the shutter 9 to the post wrapping position as the cam shaft 78 is rotated. As a consequence the wrapping rollers 86*a*, 86*b*, 86*c* are held at the wrapping roller wrapping positions WRAPP. After the coin support post 70 supporting the predetermined number of the stacked coins on the upper surface thereof has reached the post wrapping position, and the cam shaft 78 has been rotated by about 110 degrees, the three wrapping roller 86*a*, 86*b*, 86*c* are moved from the wrapping roller waiting positions WAITP to the wrapping roller wrapping positions WRAPP where the wrapping rollers 86*a*, 86*b*, 86*c* are closest to each other and the stacked coins can be wrapped and held therebetween. Although the traveling distance of the wrapping rollers 86*a*, 86*b*, 86*c* caused by the first wrapping roller position adjusting cam 95 is constant, since the wrapping rollers 86*a*, 86*b*, 86*c* are located by the second wrapping roller position adjusting cam 99 so as to be spaced from each other by predetermined spacings in accordance with the denomination of the coins to be wrapped before the cam shaft 78 begins to be rotated, it is possible for the first wrapping roller position adjusting cam 95 to locate the wrapping rollers 86*a*, 86*b*, 86*c* at the wrapping roller wrapping positions WRAPP where the coins stacked on the upper surface of the coin support post 70 can be wrapped. Immediately before the wrapping rollers 86*a*, 86*b*, 86*c* are moved from the wrapping roller waiting positions WAITP to the wrapping roller wrapping positions WRAPP, the wrapping film 106 is fed by the film feeding rollers 107*a*, 107*b* from a wrapping film roll (not shown) to between the stacked coins supported on the upper surface of the coin support post 70 and the wrapping rollers 86*a*, 86*b*, 86*c* and is held together with the stacked coins between the wrapping rollers 86*a*, 86*b*, 86*c*, whereby the stacked coins are wrapped.

On the contrary, the portion of the cam profile of the crimp claw retracting cam 123 against which the cam follower 122 abuts does not substantially change until the cam shaft 78 has been rotated by about 155 degrees and, therefore, the crimp claws are not substantially moved at the crimp claw retracted position. However, after the cam shaft 78 has been rotated by about 155 degrees, the portion of the cam profile of the crimp claw retracting cam 123 against which the cam follower 122 abuts gradually becomes concave and the crimp claw retracting arm 121 is swung counterclockwise about the support shaft 120. As a result, the arm 124 integrally formed with the crimp claws is swung about the support shaft 127, whereby the pair of crimp claws are moved to above and below the stacked coins around which the wrapping film 106 has been wound. Then, the crimp claw actuating cam 129 is rotated and the upper and lower end portions of the wrapping film 106 wound around the stacked coins are crimped.

When the wrapping and the crimping of the wrapping film 106 have been completed and the cam shaft 78 has been rotated by about 270 degrees, the portion of the cam profile of the post elevating and lowering cam 77 against which the cam follower 76 abuts becomes concave again and the coin support post 70 is further lowered from the post wrapping position. When the cam shaft 78 has been rotated by about 290 degrees, the portion of the cam profile of the post retracting cam 116 against which the cam follower 117 abuts gradually becomes convex and, as a result, the coin support post 70 is moved from the space between the wrapping rollers 86*a*, 86*b*, 86*c* to the post retracted position.

When the cam shaft 78 has been rotated by about 320 degrees, the portion of the cam profile of the crimp claw retracting cam 123 against which the cam follower 122 abuts gradually becomes convex and the crimp claws are moved to the crimp claw retracted positions.

When the cam shaft 78 has been rotated by about 340 degrees, the portion of the cam profile of the first wrapping roller position adjusting cam 95 against which the cam follower 94 abuts gradually becomes convex and the wrapping rollers 86*a*, 86*b*, 86*c* are moved from the wrapping roller wrapping positions WRAPP to the wrapping roller waiting positions WAITP.

Thus, one cycle of the wrapping operation is completed.

Figure 12:
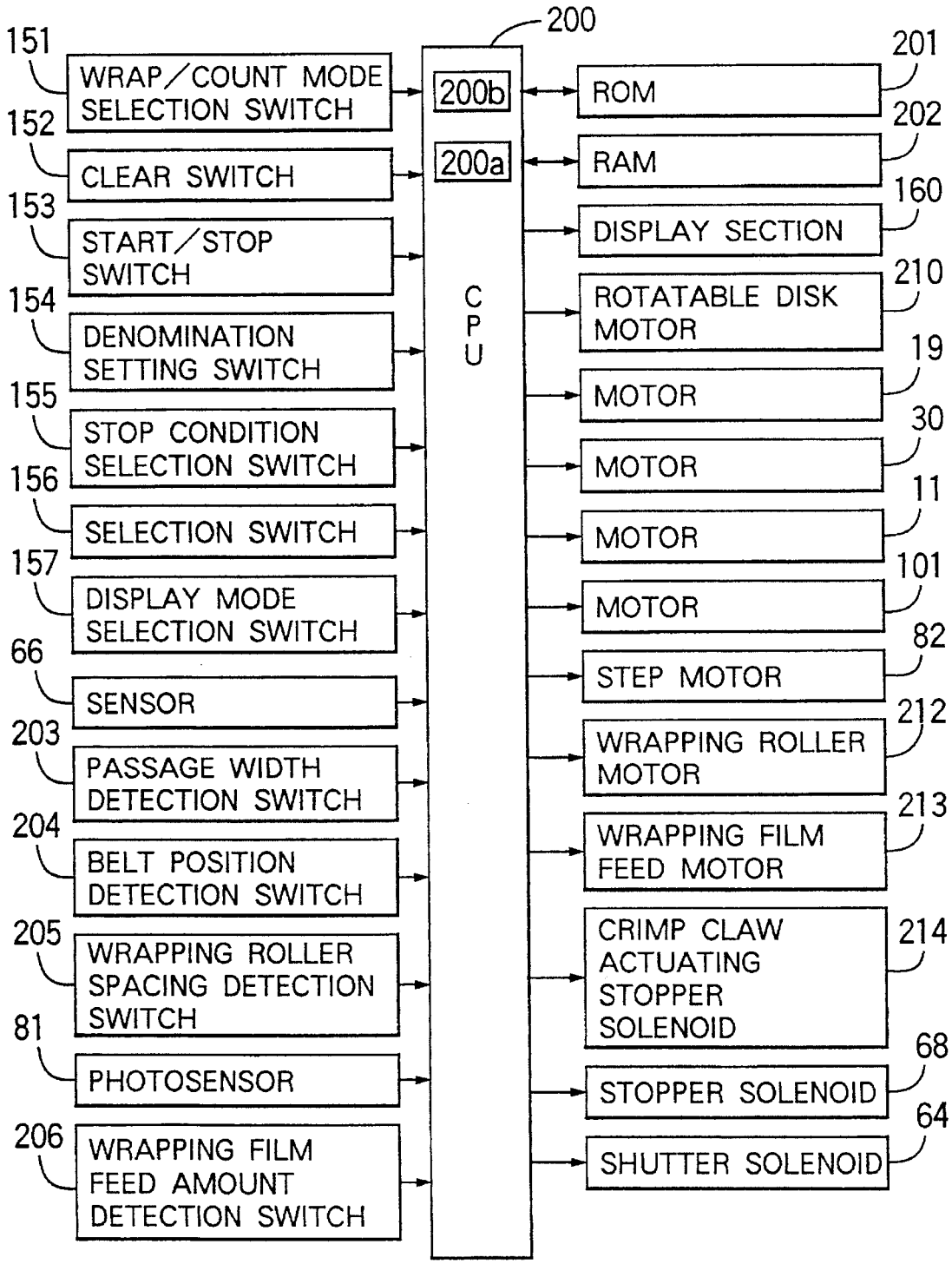
FIG. 12 is a block diagram of a control system, a storage system, a driving system, a detection system and an operation system of a coin wrapping machine which is an embodiment of the present invention.

FIG. 12 is a block diagram of a control system, a storage system, a driving system, a detection system and an operation system of the thus constituted coin wrapping machine which is an embodiment of the present invention.

As shown in FIG. 12, the control, storage, driving, detection and operation systems of the coin wrapping machine which is an embodiment of the present invention includes a CPU 200 as control means. The CPU 200 can access a ROM (read-only memory) 201 for storing various data such as an operation program for the coin wrapping machine, registered coin data stored in advance concerning the diameter and thickness of coins, and a reference wrapping unit number for each denomination of coins and the like, a reference number M0 of coins to be stacked in the coin temporary stacking section 7, the wrapping roller retracted positions RETP where the wrapping rollers 86*a*, 86*b*, 86*c* should be located when coins are to be counted, the wrapping roller waiting positions WAITP where the wrapping rollers 86*a*, 86*b*, 86*c* should be located prior to starting the wrapping of coins in accordance with the denomination of registered coins to be wrapped, the number of pulses that have to be output to the step motor 82 in order to lower the coin support post 70 by the thickness of one registered coin, and the like. The CPU 200 can also access a RAM (random access memory) 202 for storing various data such as coin data newly stored by the operator concerning the diameter, thickness, and a reference wrapping unit number of newly registered denominations of coins, the wrapping roller waiting positions WAITP where the wrapping rollers 6*a*, 86*b*, 86*c* should be located in accordance with the newly registered denominations of the coins to be wrapped, the number of pulses that have to be output to the step motor 82 in order to lower the coin support post 70 by the thickness of one newly registered coin, the denomination of coins to be counted or wrapped, the number of coins detected by the sensor 66, information on whether or not the shutter 9 is opened, the number and/or the total thickness of the coins stacked in the coin temporary stacking section 7, and the like.

The CPU 200 includes a new coin data registering section 200*a* which receives the new coin data and stores them in the RAM 202 in a registration mode described later, and a coin data reading section 200*b* which reads out the coin data from the ROM 201 or RAM 202. Further, since the RAM 202 is connected to a back-up power source (not shown), data stored in the RAM 202 are maintained even when the electric power source is off.

The tables in FIGS. 13A and 13B show registered coin data RD stored in advance in the ROM 201 and coin data ND newly stored in the RAM 202, respectively. This embodiment of the coin wrapping machine is intended to be used in Japan. Accordingly, the registered coin data RD comprise data for the six denominations of coins currently in circulation in Japan, namely, 1-yen coin data RD1, 5-yen coin data RD2, 10-yen coin data RD3, 50-yen coin data RD 4, 100-yen coin data RD5, and 500-yen coin data RD6. Each set of the coin data RD1 to RD6 comprises denomination data, coin diameter data, coin thickness data, and reference wrapping unit number data. For example, in the case of the coin data RD1, "1 yen", "20.0", "1.50", and "50" are stored as the denomination data, the coin diameter data, the coin thickness data, and the reference wrapping unit number data, respectively. The reference wrapping unit number data indicate the number of coins to be wrapped in one wrapped coin roll. On the other hand, six kinds of coin data ND1 to ND 6 can be stored as the newly stored coin data ND and each set of the coin data ND1 to ND6 comprises denomination data, coin diameter data, coin thickness data, and reference wrapping unit number data.

As shown in FIG. 12, the CPU 200 receives operation signals from a wrap/count mode selection switch 151, a clear switch 152, a start/stop switch 153, a denomination setting switch 154, a stop condition selection switch 155, a selection switch 156 and a display mode selection switch 157 and outputs a display signal to a display section 160 for causing it to display predetermined information.

Figure 14:
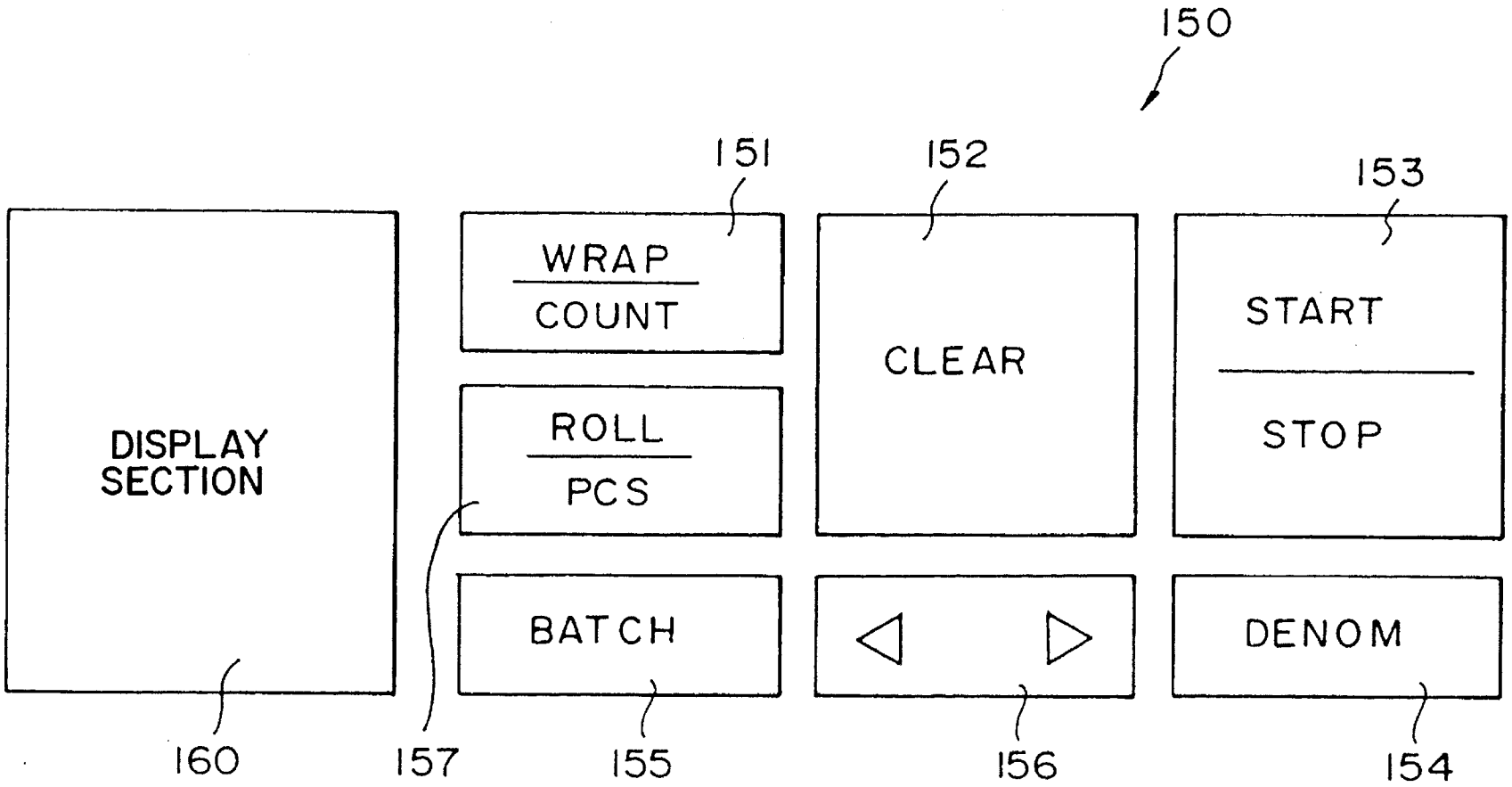
FIG. 14 is a schematic plan view showing an operating section and a display section provided on an outer surface of a coin wrapping machine.

FIG. 14 is a schematic plan view showing an operating section and a display section provided on an outer surface of the thus constituted coin wrapping machine which is an embodiment of the present invention.

As shown in FIG. 14, the operating section 150 provided on an outer surface of the coin wrapping machine which is an embodiment of the present invention includes the wrap/count mode selection switch (WRAP/COUNT) 151 for selecting whether the coin wrapping machine should be operated to wrap or count coins, the clear switch (CLEAR) 152 for causing the coin wrapping machine to effect a preparatory operation prior to wrapping or counting coins, the start/stop switch (START/STOP) 153 for actuating or stopping the coin wrapping machine, the denomination setting switch (DENOM) 154 operated in the case where the denomination of the coins to be wrapped or counted is set, the stop condition selection switch (BATCH) 155 operated for selecting, when coins are to be wrapped, whether the coins should be wrapped and the coin wrapping operation should not be stopped until the number of the wrapped coin rolls including a predetermined number of coins has become equal to the specified number or until the total number of wrapped coins has become equal to the specified number, or selecting, when coins are to be counted, whether coins should be counted and the counting operation should not be stopped until the number of the counted coins has become equal to the specified number or until all deposited coins have been counted, the selection switch 156 for selecting the denomination or the condition for stopping the coin wrapping machine when the denomination setting switch 154 was operated or the stop condition selection switch 155 was operated, and the display mode selection switch 157 (ROLL/

PCS) for causing the display section 160 to display the number of the wrapped coin rolls of coins or the number of the wrapped coins.

More specifically, the coin wrapping and counting operation and the coin counting operation are alternately selected each time the wrap/count mode selection switch (WRAP/COUNT) 151 is operated.

Similarly, the coin wrapping and counting operation or the coin counting operation is started or the coin wrapping and counting operation or the coin counting operation is stopped each time the start/stop switch 153 is operated.

Further, if the denomination setting switch 154 is operated, the denominations which can be selected are displayed on the display section 160 and it becomes possible to arbitrarily set the denomination of the coins to be wrapped and counted or to be counted by operating the selection switch 156.

Figure 15:
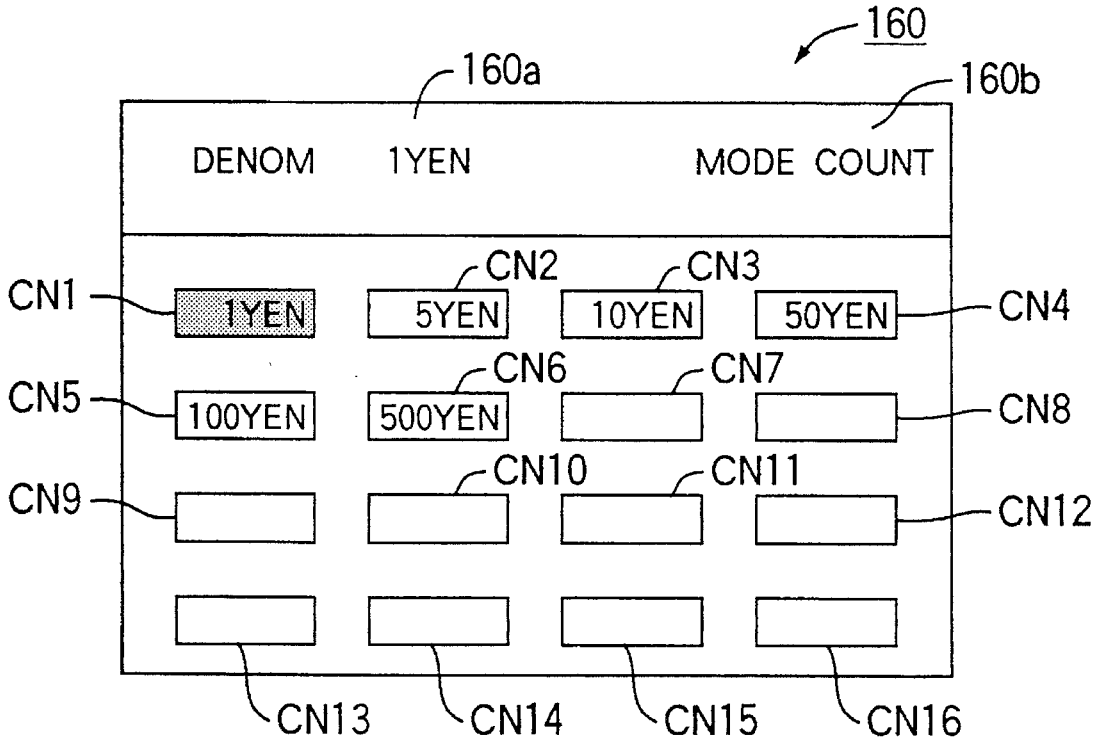
FIG. 15 is a schematic plan view showing a display section when a denomination setting switch is operated.

In this case, as shown in FIG. 15, the denominations stored in advance in the ROM 201 are displayed on character portions CN1 to CN10 of the display section 160. The denominations newly stored in the RAM 202 using the new coin data registering section 200*a* as described later can be displayed on character portions CN11 to CN16. In the illustrated embodiment, since the coin data RD1 to RD6 for six denominations of coins are stored in the ROM 201, the names of the denominations corresponding to the coin data RD1 to RD6, namely, "1 YEN", "5 YEN", "10 YEN", "50 YEN", "100 YEN", and "500 YEN" are displayed on the character portions CN1 to CN6. The denomination selected using the selection switch 156 and the mode selected using the wrap/count mode selection switch (WRAP/COUNT) 151 are displayed on portions 160*a* and 160*b* of the display section 160, respectively. In the illustrated embodiment, since 1 yen is selected using the selection switch 156, "1 YEN" is displayed on the portion 160*a*, and since the counting mode is selected by the wrap/count mode selection switch (WRAP/COUNT) 151, the portion 160*b* indicates that the counting mode is selected.

If the stop condition selection switch 155 is operated, it becomes possible by operating the selection switch 156 to specify the number of wrapped coin rolls or the number of coins to be wrapped when the coin wrapping and counting operation is to be effected, or to specify the number of coins after which the coin counting operation should be stopped when only the coin counting operation is to be effected.

In addition, if the predetermined switches are simultaneously operated in a predetermined manner, the registration mode is selected and the coin data concerning the diameter, thickness, and the like of the coins can be newly stored in the RAM 202 as described later.

The display section 160 is constituted so as to display information on, for example, whether coin wrapping is being effected or whether coin counting is being effected, the denomination of the coins to be wrapped or counted specified by the operator, the number of coin rolls to be wrapped or the total number of coins, the number of wrapped coin rolls which have been produced or the total number of coins which have been wrapped, and warnings for notifying the operator that some trouble has occurred, or the like.

Further, as shown in FIG. 12, the CPU 200 receives, a coin detection signal from the sensor 66, a passage width detection signal from a passage width detection switch 203 comprising the rotary encoders 60, 61 for detecting the width of the coin sorting passage 4, namely, the spacing between the pair of guide members 5, 6, a belt position detection signal from a belt position detection switch 204 comprising the rotary encoder 22 for detecting the position of the transporting belt 10, a wrapping roller spacing detection signal from a wrapping roller spacing detection switch 205 comprising the rotary switch 105 for detecting the spacing between the wrapping rollers 86*a*, 86*b*, 86*c*, a cam shaft rotation position detection signal from the photosensor 81 for detecting the rotation position of the cam shaft 78 by detecting the cut portions 79*a*, 79*b* of the disk 80, and a wrapping film feed amount detection signal from a wrapping film feed amount detection switch 206 for detecting the length of the wrapping film 106 fed.

Moreover, the CPU 200 is constituted so as to output drive signals or stop signals to a rotatable disk motor 210 for rotating the rotatable disk 1, the motor 19 for driving the transporting belt 10, the motor 30 for adjusting the width of the coin sorting passage 4, namely, the spacing between the guide members 5, 6, the motor 11 for adjusting the position of the transporting belt 10, the motor 101 for adjusting the spacing between the wrapping rollers 86*a*, 86*b*, 86*c*, the step motor 82 for rotating the cam shaft 78, a wrapping roller motor 212 for rotating the wrapping rollers 86*a*, 86*b*, 86*c*, a wrapping film feed motor 213 for rotating the wrapping film feed rollers 107*a*, 107*b*, and a crimp claw actuating stopper solenoid 214 for driving the crimp claw actuating stopper 128, to output a rotation signal or a reverse rotation signal to the stopper solenoid 68 for rotating the stopper 67, and to output an open signal or a close signal to the shutter solenoid 64 for opening or closing the shutter 9.

Figure 16:
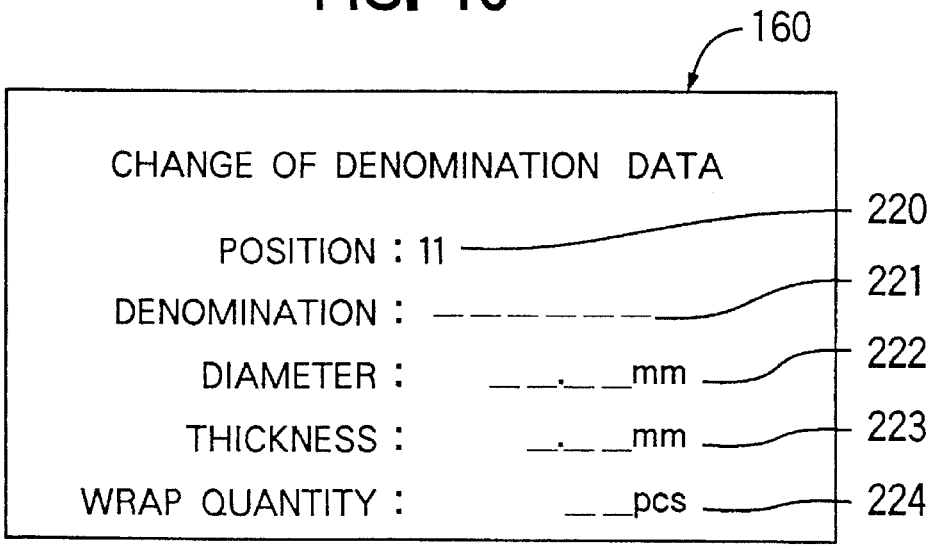
FIG. 16 is a schematic plan view showing a display section at a registration mode.

The thus constituted coin wrapping machine which is an embodiment of the present invention will now be explained regarding the registration mode which enables the coin data ND to be newly stored in the RAM 202. When the electrical power source is turned on with the denomination setting switch 154 and the stop condition selection switch 155 simultaneously pressed, the new coin data registering section 200*a* of the CPU 200 is activated and the display shown in FIG. 16 appears on the display section 160. A cursor (not shown) indicates the position display portion 220 at this time. In the registration mode, the input means are the selection switch 156, the start/stop switch 153 and the clear switch 152. The numerals and the like displayed at the individual display portions can be changed by operating the selection switch 156, and the cursor is moved from side to side by operating the start/stop switch 153 and the clear switch 152.

Initially, the operator uses the selection switch 156 to select the numeral to be displayed at the position display portion 220 from among the numerals of 11 to 16. These numerals 11 to 16 correspond to the newly stored coin data ND1 to ND6. Then, the operator uses the start/stop switch 153 to move the cursor to a denomination display portion 221. As the selection switch 156 is operated, alphanumeric characters are successively displayed at the cursor position. It is possible by properly operating the selection switch 156, the start/stop switch 153 and the clear switch 152 to display the denomination of the coin to be newly stored, the coin diameter, the coin thickness, and the reference wrapping unit number, namely, the number of the coins to be wrapped in one wrapped coin roll, on the denomination display portion 221, a diameter display portion 222, a thickness display portion 223, and a wrap quantity display portion 224. The data displayed on the portions 221 to 224 correspond to the denomination data, the coin diameter data, the coin thickness data, and the reference wrapping unit number data of the newly stored coin data ND. Consequently, when the operator has completed inputting predetermined alphanumeric characters, the new coin data registering section 200*a* reads out the data from the display portions 221 to 224 and stores them in the area of the RAM 202 in which the coin data ND(i-10) (i=11 to 16) corresponding to the numeral "i" displayed on the position display portion 220 are to be stored.

In accordance with the newly stored coin diameter data and the coin thickness data of the coin data ND, the CPU 200 calculates the wrapping roller waiting positions where the wrapping rollers 86*a*, 86*b*, 86*c* should be located prior to starting the wrapping of the coins, and also calculates the number of pulses that have to be output to the step motor 82 in order to lower the coin support post 70 by the thickness of one coin. Then, the CPU 200 stores the calculated data in a predetermined area of the RAM 202. Finally, the registration mode terminates by turning off the electrical power source.

The thus constituted coin wrapping machine operates in the following manner in the case where only coin counting is effected.

When an electrical power source (not shown) is turned on, the number of coins detected by the sensor 66 and stored in the RAM 202 is displayed on the display section 160. This number is zero when the operation is first started.

The wrap/count mode selection switch 151 and the denomination setting switch 154 can be operated only when the number of coins detected by the sensor 66 and stored in the RAM 202 is zero and the wrap/count mode selection switch 151 is operated by the operator to switch from the wrapping mode to the counting mode, whereby counting is selected.

Then, the operator operates the clear switch 152. When the clear switch 152 is operated, the CPU 200 outputs drive signals to the rotatable disk motor 210 and the motor 19 and outputs a reverse rotation signal to the stopper solenoid 68, thereby reversely rotating the rotatable disk 1, reversely driving the transporting belt 10 for a predetermined time period and further rotating the stopper 67 so that the cut flat side surface thereof is flush with the inner surface of the guide member 6.

As a result, any coins remaining or jammed in the coin sorting passage 4 are returned onto the rotatable disk 1.

After a predetermined time period has passed, the CPU 200 outputs drive stop signals to the rotatable disk motor 210 and the motor 19 and outputs a rotation signal to the stopper solenoid 68 to close the coin sorting passage 4.

When the clear switch 152 is operated, in the case where the wrapping mode was selected and coin wrapping and counting were effected in the previous cycle, the CPU 200 simultaneously outputs an open signal to the shutter solenoid 64 and outputs drive signals to the step motor 82 for rotating the cam shaft 78, the motor 101 for adjusting the spacing between the wrapping rollers 86*a*, 86*b*, 86*c* and the crimp claw actuating stopper solenoid 214 for driving the crimp claw actuating stopper 128 and in the case where the counting mode was selected and coin counting was effected in the previous cycle, the CPU 200 does not output an open signal to the shutter solenoid 64 since the shutter 9 is already open.

In the case where coin wrapping and counting were effected in the previous cycle, the coin support post 70 is located at the post waiting position immediately below the shutter 9 and since the shutter 9 opens the space between the pair of stacking blocks 8*a*, 8*b*, any coins remaining in the coin temporary stacking section are transferred onto the upper surface of the coin support post 70 located at the post waiting position. Since the drive signal to the step motor 82 continues to be output until the photosensor 81 detects the large cut portion 79*b* of the disk 80, the coin support post 70 is lowered to the post wrapping position, whereby the coins transferred onto the upper surface of the coin support post 70 and/or remaining on the upper surface of the coin support post 70 are held between the wrapping rollers 86*a*, 86*b*, 86*c* located at the wrapping roller wrapping positions WRAPP . Then, the coin support post 70 is moved to the post retracted position where the coin support post 70 is retracted from the space between the wrapping rollers 86*a*, 86*b*, 86*c* and the wrapping rollers 86*a*, 86*b*, 86*c* are moved to the wrapping roller retracted positions RETP so that the spacing therebetween becomes great, whereby the coins held between the wrapping rollers 86*a*, 86*b*, 86*c* fall downward in the space between the three wrapping rollers 86*a*, 86*b*, 86*c*.

The drive signal to the motor 101 for adjusting the spacing between the wrapping rollers 86*a*, 86*b*, 86*c* is output until the wrapping roller spacing detection switch 205 detects that the wrapping rollers 86*a*, 86*b*, 86*c* have reached the wrapping roller retracted positions determined irrespective of the denomination of the coins to be counted such that the spacing between the wrapping rollers 86*a*, 86*b*, 86*c* is maximum.

On the other hand, the drive signal to the crimp claw actuating stopper 128 is output until the photosensor 81 detects the large cut portion 79*b* of the disk 80 and, therefore, the crimp claws (not shown), are held at the crimp claw retracted positions by the crimp claw actuating stopper 128 until the coin support post 70 is lowered from the post waiting position immediately below the shutter 9 to the post retracted position. Accordingly, if coins remain in the coin temporary stacking section 7 and/or on the upper surface of the coin support post 70 and, as a result, when the coin support post 70 is lowered from the post waiting position to the post retracted position while on the upper surface thereof supporting coins in a number which is less than the number of coins to be wrapped in a wrapped coin roll and the coins are held between the wrapping rollers 86*a*, 86*b*, 86*c*, the crimp claws are held at the crimp claw retracted positions irrespective of the rotation of the cam shaft 78. Therefore, the coins are prevented from being damaged by the crimp claws moved to the crimping positions and by the crimping operation and the coins held between the wrapping rollers 86*a*, 86*b*, 86*c* are prevented from being scattered by an undesirable force applied thereto.

The shutter solenoid 64 is kept open until the clear switch 152 has been operated, the coin counting has been completed, and the wrapping mode has been selected by operating the wrap/count mode selection switch 151.

On the contrary, when the counting mode was selected and coin counting was effected in the previous cycle, the coin support post 70 is located at the lower post retracted position, the three wrapping rollers 86*a*, 86*b*, 86*c* are located at the wrapping roller retracted positions RETP and the crimp claws are located at the crimp claw retracted positions. Therefore, even when the clear switch 152 is operated, the CPU 200 does not output an open signal to the shutter solenoid 64 and also does not output drive signals to the step motor 82 for rotating the cam shaft 78 and the crimp claw actuating stopper solenoid 214 for driving the crimp claw actuating stopper 128.

When the operator operates the denomination setting switch 154 and the selection switch 156 so as to select the denomination of coins to be counted, the coin data reading section 200*b* of the CPU 200 reads out the coin data RD or ND such as the coin diameter data and the coin thickness data of the selected denomination from the ROM 201 or RAM 202.

Based upon the coin data RD or ND, the CPU 200 further outputs drive signals to the motor 30 for adjusting the spacing between the guide members 5, 6 and to the motor 11 for adjusting the position of the transporting belt 10, thereby adjusting the spacing between the guide members 5, 6 and the position of the transporting belt 10. This adjustment is effected until the spacing between the guide members 5, 6 and the position of the transporting belt 10 determined based upon a passage width detection signal from the passage width detection switch 203 and a belt position detection signal from the belt position detection switch 204 coincide with a target spacing between the guide members 5, 6 and a target position of the transporting belt 10 corresponding to the diameter and the thickness of the coins of the denomination to be counted which are read out from the ROM 201 or RAM 202. When the width of the coin sorting passage 4, namely, the spacing between the guide members 5, 6 is adjusted by the motor 30, the spacing between the stacking blocks 8*a*, 8*b* is synchronously adjusted in accordance with the selected denomination of the coins.

When the preparatory operation has been completed in the foregoing manner, the stop condition selection switch 155 becomes operable and when the operator operates the stop condition selection switch 155 to specify the number NO of coins by which the counting should be completed, the CPU 200 stores the number NO in the RAM 202 and when the operator does not specify the number NO of coins by which the counting should be completed, it stores an infinite number in the RAM 202.

When all preparatory operations have been completed, information indicating that coin counting can be effected is displayed on the display section 160 and the coin wrapping machine is ready for counting coins.

After the operator has deposited coins into a coin depositing section (not shown) and then operated the start/stop switch 153, the coin counting operation is started.

More specifically, when the start/stop switch 153 is operated and a start signal is input to the CPU 200, the CPU 200 outputs drive signals to the rotatable disk motor 210 and the motor 19 and outputs a reverse rotation signal to the stopper solenoid 68. As a result, the rotatable disk motor 210 and the motor 19 are forwardly driven and the stopper solenoid 68 rotates the stopper 67 so that the cut flat side surface thereof is flush with the inner surface of the guide member 6.

As a consequence, since the width of the coin sorting passage 4, namely, the spacing between the guide members 5, 6 has been adjusted so as to correspond to the diameter of the denomination of coins to be counted, the coins of the denomination to be counted and any smaller coins are fed from the rotatable disk 1 into the coin sorting passage 4, whereas coins having greater diameter than that of the coins of the denomination to be counted remain on the rotatable disk 1 and are not fed into the coin sorting passage 4.

On the other hand, the coins which have a smaller diameter than that of the coins of the denomination to be counted and have been fed into the coin sorting passage 4 fall downward between the guide members 5, 6 and are collected in a small coin collecting box (not shown).

Thus, only the coins of the denomination to be counted pass along the coin sorting passage 4 and are detected by the sensor 66. The sensor 66 outputs a coin detection signal each time it detects the coin and the CPU 200 increases the number stored in the RAM 202 by one each time it receives the coin detection signal from the sensor 66.

After the coins has passed by the sensor 66, they are fed into the coin temporary stacking section 7. Since each of the pair of stacking blocks 8*a*, 8*b* is formed such that the downstream portion thereof is higher than the upstream portion thereof, each coin fed along the coin sorting passage 4 is directed downward by collision with the inner walls of the downstream portions of the stacking blocks 8*a*, 8*b*. Since the shutter 9 is open, the wrapping rollers 86*a*, 86*b*, 86*c* are located at the wrapping roller retracted positions RETP, and the coin support post 70 is located at the lower position and the post retracted position, the coin fed into the coin temporary stacking section 7 falls between the wrapping rollers 86*a*, 86*b*, 86*c* and is collected in a designated denomination coin collecting box (not shown).

On the other hand, when the operator operates the stop condition selection switch 155 to specify the number NO of coins by which the counting should be completed, the CPU 200 judges whether or not the number stored in the RAM 202 coincides with the specified number NO.

As a result, when the number stored in the RAM 202 is smaller than the specified number NO, coin counting is continued and the coins fall between the wrapping rollers 86*a*, 86*b*, 86*c* via the coin sorting passage 4 and the coin temporary stacking section 7 and are collected in the designated denomination coin collecting box.

On the contrary, when the CPU 200 judges that the number stored in the RAM 202 has become equal to the specified number NO, it outputs drive stop signals to the rotatable disk motor 210 and the motor 19 and outputs a rotation signal to the stopper solenoid 68, thereby causing the stopper to close the coin sorting passage As a result, no coins are fed from the rotatable disk 1 into the coin sorting passage 4 and the stopper 67 prevents coins from being fed to downstream of the stopper 67, whereby coin counting is completed.

When coin counting has been completed in this manner, the CPU 200 displays the fact that counting of the specified number of coins has been completed on the display section 160.

On the other hand, if the operator does not operate the stop condition selection switch 155 and the number NO of coins by which the counting should be completed is not specified, the coin counting is continued until all coins of the specified denomination fall between the wrapping rollers 86*a*, 86*b*, 86*c* via the coin sorting passage 4 and the coin temporary stacking section 7 and are collected in the set denomination coin collecting box and when no coin detection signal is input from the sensor 66 after a predetermined time period has passed since the last coin detection signal was input to the CPU 200 from the sensor 66, the CPU 200 outputs drive stop signals to the rotatable disk motor 210 and the motor 19 and outputs a rotation signal to the stopper solenoid 68, thereby causing the stopper 67 to close the coin sorting passage 4.

Further, the CPU 200 judges that the counting of coins of the specified denomination has been completed and outputs a display signal to the display section 160, thereby displaying the number of coins of the specified denomination detected by the sensor 66 and stored in the RAM 202 on the display section 160 and also displaying the fact that the coin counting has been completed.

After coin counting has been completed in the above described manner, the operator opens the lid of the coin wrapping machine and removes the coins having greater diameter than that of the specified denomination of coins and remaining on the rotatable disk 1.

On the contrary, when the number of coins stored in the RAM 202 is equal to zero at the time the electrical power source (not shown) is turned on and the operator operates the wrap/count selection switch 151 to select the wrapping mode, the coin wrapping machine wraps coins in the following manner.

Similarly to the case of coin counting, when the clear switch 152 is operated, the CPU 200 outputs drive signals to the rotatable disk motor 210 and the motor 19 and outputs a reverse rotation signal to the stopper solenoid 68, thereby reversely rotating the rotatable disk 1, reversely driving the transporting belt 10 and rotating the stopper 67 so that the cut flat side surface thereof is flush with the inner surface of the guide member 6.

As a result, any coins remaining or jammed in the coin sorting passage 4 are returned onto the rotatable disk 1.

After a predetermined time period, the CPU 200 outputs drive stop signals to the rotatable disk motor 210 and the motor 19 and outputs a rotation signal to the stopper solenoid 68, thereby causing the stopper 67 to close the coin sorting passage 4.

When the clear switch 152 is operated, the CPU 200 simultaneously outputs drive signals to the step motor 82 for rotating the cam shaft 78 and the crimp claw actuating stopper solenoid 214 for driving the crimp claw actuating stopper 128 and when the wrapping mode was selected and coin wrapping and counting were effected in the previous cycle, it outputs an open signal to the shutter solenoid 64. On the contrary, when the counting mode was selected and coin counting was effected in the previous cycle, since the shutter 9 is open, the CPU 200 does not output an open signal to the shutter solenoid 64 but outputs a drive signal to the motor 101 to move the wrapping rollers 86*a*, 86*b*, 86*c* from their most separated positions at the wrapping roller retracted positions to the wrapping roller waiting positions corresponding to the coins of the denomination specified in the previous cycle.

The drive signal is output to the step motor 82 until the photosensor 81 detects the small cut portion 79*a* of the disk 80.

Accordingly, when the counting mode was selected and coin counting was effected in the previous cycle, the coin support post 70 is moved from the lower post retracted position to the post waiting position immediately below the shutter 9 and the wrapping rollers 86*a*, 86*b*, 86*c* are moved from the wrapping roller retracted positions RETP to the wrapping roller waiting positions WAITP corresponding to the denomination of the coins to be wrapped.

On the other hand, when the wrapping mode was selected and coin wrapping and counting were effected in the previous cycle, the coin support post 70 is located at the post waiting position immediately below the shutter 9. Nevertheless, the cam shaft 78 is rotated by one cycle so that the coin support post 70 is lowered to the post retracted position and then elevated to the post waiting position immediately below the shutter 9.

Therefore, in the case where the wrapping mode was selected so as to effect coin wrapping and counting and coins remain in the coin temporary stacking section 7 above the shutter 9, since the shutter 9 opens the space between the pair of stacking blocks 8*a*, 8*b*, these coins are transferred onto the upper surface of the coin support post 70 located at the post waiting position. Then, the coin support post 70 is lowered to the post wrapping position and the coins transferred onto the upper surface of the coin support post 70 and the coins remaining on the upper surface of the coin support post 70 are held between the wrapping rollers 86*a*, 86*b*, 86*c* all together. The coin support post 70 is, then, moved to the post retracted position where it is retracted from the space between the wrapping rollers 86*a*, 86*b*, 86*c* and the wrapping rollers 86*a*, 86*b*, 86*c* are moved to the wrapping roller wrapping positions WRAPP. As a result, the spacing between the wrapping rollers 86*a*, 86*b*, 86*c* becomes great and the coins held between the wrapping rollers 86*a*, 86*b*, 86*c* fall in the space between the wrapping rollers 86*a*, 86*b*, 86*c*. Then, the coin support post 70 is moved from the post retracted position to the post waiting position immediately below the shutter 9.

On the other hand, the drive signal is output to the crimp claw actuating stopper solenoid 128 until the photosensor 81 detects the small cut portion 79*a* of the disk 80 and, therefore, the crimp claws (not shown) are held at the crimp claw retracted positions until the coin support post 70 has been moved to the post waiting position immediately below the shutter 9. Accordingly, if coins remain in the coin temporary stacking section 7 and/or on the upper surface of the coin support post 70 and, as a result, when the coin support post 70 is lowered from the post waiting position to the post retracted position with coins in a number which is less than the number of coins to be wrapped in a wrapped coin roll supported on the upper surface thereof and the coins are held between the wrapping rollers 86*a*, 86*b*, 86*c*, the crimp claws are held at the crimp claw retracted positions irrespective of the rotation of the cam shaft 78. Therefore, since the crimp claws are not moved to the crimping positions and the crimping operation is not effected, the coins are prevented from being damaged by the crimp claws and the crimping operation, and the coins held between the wrapping rollers 86*a*, 86*b*, 86*c* are prevented from being scattered by an undesirable force applied thereto.

When an open signal is output to the shutter solenoid 64, its output is maintained until a predetermined time period has passed after the clear switch 152 was operated, and the CPU 200 then outputs a close signal to close the shutter 9.

When the operator operates the denomination setting switch 154 and the selection switch 156 so as to select the denomination of the coins to be wrapped, the coin data reading section 200*b* of the CPU 200 reads out the coin data RD and ND such as the coin diameter data and the coin thickness data of the selected denomination from the ROM 201 and the RAM 202.

Based upon the coin data RD or ND, the CPU 200 further outputs drive signals to the motor 30 for adjusting the spacing between the guide members 5, 6 and to the motor 11 for adjusting the position of the transporting belt 10, thereby adjusting the spacing between the guide members 5, 6 and the position of the transporting belt 10. This adjustment is effected until the spacing between the guide members 5, 6 and the position of the transporting belt 10 determined based upon a passage width detection signal from the passage width detection switch 203 and a belt position detection signal from the belt position detection switch 204 coincide with a target spacing between the guide members 5, 6 and a target position of the transporting belt 10 corresponding to the diameter and the thickness of the coins of the denomination to be counted which are read out from the ROM 201 or the RAM 202. When the width of the coin sorting passage 4, namely, the spacing between the guide members 5, 6 is adjusted by the motor 30, the spacing between the stacking blocks 8*a*, 8*b* is synchronously adjusted in accordance with the selected denomination of the coins.

When the denomination setting switch 154 is operated and the selection switch 156 is operated to select the denomination of the coins to be wrapped, the CPU 200 reads out the wrapping roller waiting positions of the wrapping rollers 86*a*, 86*b*, 86*c* corresponding to the denomination of the coins from the ROM 201 or the RAM 202 and outputs a drive signal to the motor 101, thereby driving the motor 101 until, based on the spacing between the wrapping rollers 86*a*, 86*b*, 86*c* detected by the wrapping roller spacing detection switch 205, the wrapping rollers 86*a*, 86*b*, 86*c* are determined to be located at the wrapping roller waiting positions WAITP corresponding to the denomination of the coins.

When all preparatory operations have been completed in this manner, information indicating that coin wrapping can be effected is displayed on the display section 160 and the coin wrapping machine is ready for wrapping coins.

After the operator has deposited coins into the coin depositing section (not shown) and operated the start/stop switch 153, the coin counting operation is started.

More specifically, when the start/stop switch 153 is operated and a start signal is input to the CPU 200, the CPU 200 outputs drive signals to the rotatable disk motor 210 and the motor 19 and outputs a reverse rotation signal to the stopper solenoid 68. As a result, the rotatable disk motor 210 and the motor 19 are forwardly driven and the stopper solenoid 68 rotates the stopper 67 so that the cut flat side surface thereof is flush with the inner surface of the guide member 6.

As a consequence, since the width of the coin sorting passage 4, namely, the spacing between the guide members 5, 6 has been adjusted so as to correspond to the diameter of the denomination of coins to be counted, the coins of the denomination to be counted and any smaller coins are fed from the rotatable disk 1 into the coin sorting passage 4, whereas coins having greater diameter than that of the coins of the denomination to be counted remain on the rotatable disk 1 and are not fed into the coin sorting passage 4.

On the other hand, the coins which have a smaller diameter than that of the coins of the denomination to be counted and have been fed into the coin sorting passage 4 fall downward between the guide members 5, 6 and are collected in a small coin collecting box (not shown).

Thus, only the coins of the denomination to be counted pass along the coin sorting passage 4 and are detected by the sensor 66. When the sensor 66 detects a coin, it outputs a coin detection signal to the CPU 200. When the CPU 200 receives the coin detection signal from the sensor 66, it judges based upon the information about the state of the shutter 9 stored in the RAM 202 whether the shutter 9 is open or closed. In the area of the RAM 202 for storing the state of the shutter 9, "0" is stored when the shutter 9 is closed and "1" is stored when the shutter 9 is open. If "0" is stored in the area of the RAM 202, i.e. if the shutter 9 is closed, the CPU 200 increases the number stored in the RAM 202 by one.

After the coins have passed by the sensor 66, they are fed into the coin temporary stacking section 7. Since each of the pair of stacking blocks 8*a*, 8*b* is formed such that the downstream portion thereof is higher than an upstream portion thereof, each coin fed in the coin sorting passage 4 is directed downward by collision with the inner walls of the downstream portions of the stacking blocks 8*a*, 8*b*. Since the shutter 9 is closed, the coin is placed on the shutter 9.

When the CPU 200 judges that the number M of coins detected by the sensor 66 has become equal to the reference number M0 of coins to be stacked in the coin temporary stacking section 7, which number M0 is stored in the ROM 201, it outputs a drive signal to the shutter solenoid 64 to swing the shutter 9 about the shaft 63 and open it, whereby the space between the stacking blocks 8*a*, 8*b* is opened downward. Since the coin support post 70 is located at the position immediately below the shutter 9 at this time, the coin support post 70 can receive the coins stacked in the coin temporary stacking section 7 reliably the upper surface thereof. The reference number M0 of coins to be stacked in the coin temporary stacking section 7 is predetermined based upon the thickness of the stacking blocks 8*a*, 8*b*. Thus, the shutter 9 is not opened until the predetermined number M0 of coins have been stacked in the coin temporary stacking section 7. This is to ensure that the upper surface of the coin support post 70 can reliably support the coins. More specifically, if the coins should not be stacked in the coin temporary stacking section 7 but be stacked directly on the upper surface of the coin support post 70, it would be difficult to stack coins in the desired manner, because the flat area provided by the upper surface of the coin support post 70 is not as large as that of the upper surface of the shutter 9 or of a coin. In this sense, it is sufficient to set at least one as the number of coins to be received in the coin temporary stacking section 7.

Thus, when the shutter 9 is opened, the CPU 200 stores "1" in the area of the RAM 202 for storing the state of the shutter 9 and reads out from the ROM 201 or the RAM 202 the number of pulses which have to be output to the step motor 82 for lowering the coin support post 70 by the thickness of one coin of the denomination to be wrapped.

Then, when the sensor 66 detects a coin, the CPU 200 outputs a drive signal to the step motor 82 and rotates the cam shaft 78 by the number of pulses read out from the ROM 201 or the RAM 202.

As a result, the coin support post 70 is lowered by the thickness of one coin to be wrapped.

When the CPU 200 judges based upon the coin detection signal from the sensor 66 that the number M0 of coins detected by the sensor 66 has become equal to the reference wrapping unit number of coins to be wrapped in one wrapped coin roll which is stored in the ROM 201 or the RAM 202, it outputs drive stop signals to the rotatable disk motor 210 and the motor 19 to stop the rotation of the rotatable disk 1 and the drive of the transporting belt 10 and outputs a rotation signal to the stopper solenoid 68, thereby projecting the stopper 67 into the coin sorting passage 4 and preventing the following coins from being fed into the coin temporary stacking section 7.

Since at this time the coin support post 70 has not yet been lowered to the post wrapping position where the coins stacked on the upper surface thereof can be wrapped, the CPU 200 further lowers the coin support post 70. Moreover, since the coins in the number which are to be wrapped in one wrapped coin roll have already been stacked on the upper surface of the coin support post 70, it is no longer necessary to intermittently output pulse signals to the step motor 82 for controlling it in steps and, therefore, in preparation for producing the next wrapped coin roll, the CPU 200 outputs a continuous pulse signal to the step motor 82 until the photosensor 81 detects the small cut portion 79*a* of the disk 80.

When the CPU 200 detects, based on the number of pulses output to the step motor 82, that the coin support post 70 has reached the post wrapping position, it outputs a drive signal to the film feed motor 213 to rotate the film feed rollers 107*a*, 107*b*, thereby feeding the wrapping film 106 to the space between the wrapping rollers 86*a*, 86*b*, 86*c* and the stacked coins supported on the upper surface of the coin support post 70.

As is well known, when the film feed rollers 107*a*, 107*b* are rotated, the rotation force thereof is transmitted to the wrapping rollers 86*a*, 86*b*, 86*c* and the wrapping rollers 86*a*, 86*b*, 86*c* are rotated in synchronism with the rotation of the film feed rollers 107*a*, 107*b*.

Consequently, as shown in FIG. 8, the coin support post 70 is held at the post wrapping position, while the wrapping rollers 86*a*, 86*b*, 86*c* are moved from the wrapping roller waiting positions WAITP to the wrapping roller wrapping positions wrapp where they are closer to each other, thereby holding the leading end portion of the wrapping film 106 between themselves and the stacked coins. Then, in the well known manner, the rotation of the film feed rollers 107*a*, 107*b* is continued to feed the wrapping film 106 to the circumference of the stacked coins and the rotation of the wrapping rollers 86*a*, 86*b*, 86*c* is also continued, whereby the wrapping film 106 is wound around the stacked coins supported on the upper surface of the coin support post 70.

When the CPU 200 judges, based upon a detection signal from the wrapping film feed amount detection switch 206, that a length of the wrapping film 106 equal to about double the circumference of the stacked coins has been fed, it outputs a drive stop signal to the film feed motor 213, thereby stopping the rotation of the film feed rollers 107*a*, 107*b*, and outputs a drive signal to the wrapping roller motor 212, thereby rotating the wrapping rollers 86*a*, 86*b*, 86*c*. As is well known, the film feed rollers 107*a*, 107*b* are prevented from being rotated by a one-way clutch (not shown) when the wrapping rollers 86*a*, 86*b*, 86*c* are rotated by the wrapping roller motor 212.

The rotation speed of the wrapping rollers 86*a*, 86*b*, 86*c* rotated by the wrapping roller motor 212 is set greater than that of the wrapping rollers 86*a*, 86*b*, 86*c* rotated by the film feed motor 213. Therefore, since the wrapping film 106 is fed to the circumference of the stacked coins by the wrapping rollers 86*a*, 86*b*, 86*c* at a low speed, it is possible to wind the wrapping film 106 around the stacked coins reliably. On the other hand, since the wrapping rollers 86*a*, 86*b*, 86*c* are rotated at a high speed after the wrapping film 106 has been wound around the stacked coins, it is possible for the crimp claws to reliably crimp the upper and lower end portions of the wrapping film 106 at a high speed.

Since the wrapping rollers 86*a*, 86*b*, 86*c* are rotated by the wrapping roller motor 212 after the film feed rollers 107*a*, 107*b* are stopped, a tensile force is produced in the wrapping film 106 between the wrapping rollers 86*a*, 86*b*, 86*c* and the film feed rollers 107*a*, 107*b*. The wrapping film 106 is cut by the action of the tensile force pushing it against the cutter 109.

Since the step motor 82 further rotates the cam shaft 78 and the crimp claw actuating stopper 128 is not driven, the portion of the cam profile of the crimp claw retracting cam 123 against which the cam follower 122 abuts becomes concave, whereby the crimp claws (not shown) are moved from the crimp claw retracted positions to the space between the wrapping rollers 86*a*, 86*b*, 86*c*. Further, a crimping mechanism (not shown) is actuated by the crimp claw actuating cam 129 and the upper and lower end portions of the wrapping film 106 wound around the stacked coins are crimped in the well-known manner to produce a wrapped coin roll including the predetermined reference wrapping unit number of coins.

Immediately before the crimp claws finish the crimping operation, the portion of the cam profile of the post elevating and lowering cam 77 against which the cam follower 76 abuts becomes further concave and, therefore, the coin support post 70 is further lowered from the post wrapping position. Since the portion of the cam profile of the post retracting cam 116 against which the cam follower 117 abuts becomes convex, the coin support post 70 is moved from the space between the wrapping rollers 86*a*, 86*b*, 86*c* to the post retracted position.

At the time the coin support post 70 begins to be lowered from the post wrapping position, the stacked coins are held between the wrapping rollers 86*a*, 86*b*, 86*c* and the upper and lower end portions of the wrapping film 106 are being crimped by the crimp claws. There is therefore no risk of the stacked coins falling. When the cam shaft 78 is further rotated by the step motor 82, the crimp claws are vertically moved apart from each other and are further moved to the crimp claw retracted positions by the crimp claw retracting cam 123.

Thus, at the time the cam shaft 78 has been rotated by 340 degrees, the portion of the cam profile of the first wrapping roller position adjusting cam 95 against which the cam follower 94 abuts becomes convex and, as a result, the three wrapping rollers 86*a*, 86*b*, 86*c* are moved apart from each other to the wrapping roller waiting positions WAITP.

Therefore, the roll-like stacked coins wrapped with the wrapping film 106 fall via the chute (not shown) to be collected in a wrapped coin collecting box (not shown).

The CPU 200 continues to output pulse signals to the step motor 82 until the photosensor 81 detects the small cut portion 79*a* of the disk 80 and the coin support post 70 is located at the post waiting position immediately below the shutter 9. It then stops outputting pulse signals. Simultaneously, the CPU 200 outputs drive signals to the rotatable disk motor 210, the motor 19 and the shutter solenoid 64, thereby rotating the rotatable disk 1, driving the transporting belt 10 and closing the shutter 9 and outputs a reverse rotation signal to the stopper solenoid 68 to rotate the stopper 67 so that the cut side surface of thereof is flush with the side surface of the guide member 6 on the side of the coin sorting passage 4, whereby coins can pass through the coin sorting passage At the same time, the CPU 200 causes the display section 160 to display information indicating that one wrapped coin roll has been produced. This completes one cycle of the wrapping operation.

The CPU 200 repeats the above operations until the start/stop switch 153 is operated again, until it judges that no coins to be wrapped remains when no coin detection signal has been input from the sensor 66 for a predetermined time period, until wrapped coin rolls have been produced in the number specified by operating the stop condition selection switch 155, or until coins have been wrapped in the number specified.

When the start/stop switch 153 is operated again, when it is judged that no coin to be wrapped remain when the coin detection signal has not been input from the sensor 66 for a predetermined time period, when wrapped coin rolls have been produced in the number specified using the stop condition selection switch 155, or when coins have been wrapped in the number specified, the CPU 200 outputs drive signals to the rotatable disk motor 210 and the motor 19, thereby stopping the rotatable disk 1 and the transporting belt 10, and outputs a rotation signal to the stopper solenoid 68 so as to project the stopper 67 into the coin sorting passage 4.

Simultaneously, the CPU 200 causes the display section 160 to display the number of wrapped coin rolls or the number of wrapped coins and the fact that the wrapping operation was completed.

According to this embodiment, when a predetermined number of coins have been stacked in the coin temporary stacking section 7, the shutter 9 is opened to send the stacked coins onto the upper surface of the coin support post 70 standing by immediately below the shutter 9. Then, each time a coin passes by the sensor 66, the coin support post 70 is lowered by the thickness of one coin and reaches the post wrapping position when coins in the reference wrapping unit number to be wrapped have been supported by the coin support post 70. Therefore, the coin stacking section for stacking coins of the reference wrapping unit number to be wrapped which has to be provided in a prior art coin wrapping machine is not necessary and it is possible to considerably reduce the height of the coin wrapping machine with a simple structure. Further, since coins are fed to the coin temporary stacking section 7 for stacking coins similarly to in a prior art coin wrapping machine, it is possible to reliably prevent coin jamming. Moreover, since the stacked coins are wrapped by three wrapping rollers 86*a*, 86*b*, 86*c*, in a known manner it is possible to wrap coins in the desired manner.

In addition, according to this embodiment, when the coins of a new denomination different from the denominations stored in advance in the ROM 201 are to be counted or to be counted and wrapped, the registration mode can be used to input the denomination of the coin, the coin diameter, the coin thickness, and the reference wrapping unit number, and the new coin data registering section 200*a* of the CPU 200 stores the coin data ND of the denomination in the predetermined area of the RAM 202. The CPU 200 further calculates the wrapping roller waiting positions WAITP where the wrapping rollers 86*a*, 86*b*, 86*c* should be located in accordance with the coin diameter data and the coin thickness data of the coin data ND which were newly stored prior to starting the wrapping of coins, and calculates the number of pulses that have to be output to the step motor 82 in order to lower the coin support post 70 by the thickness of one coin which is newly stored, and stores the results in the predetermined area of the RAM 202. Consequently, if the denomination setting switch 154 and then the selection switch 156 are operated so as to select the denomination of the coins to be counted or to be counted and wrapped, the coin data reading section 200*b* reads out the coin data RD or ND from the ROM 201 or the RAM 202 in accordance with the selected denomination and, based on the data RD or ND, the CPU 200 determines the spacing between the guide member 5, 6, the spacing between the stacking blocks 8*a*, 8*b*, the position of the transporting belt 10, the wrapping roller waiting positions WAITP where the wrapping rollers 86*a*, 86*b*, 86*c* should be located prior to starting the wrapping of coins, and the number of pulses that have to be output to the step motor 82 in order to lower the coin support post 70 by the thickness of one coin of the selected denomination, and operates the coin wrapping machine in accordance therewith. It is, therefore, possible to properly count or to properly count and wrap newly issued coins or other coins whose denominations were not registered in advance.

The present invention has thus been shown and described with reference to specific embodiments. However, it should be noted that the present invention is in no way limited to the details of the described arrangements but changes and modifications may be made without departing from the scope of the appended claims.

For example, although in the above described embodiment, the coin processing machine is explained as a coin wrapping machine, the present invention can be applied not only to the coin wrapping machine of the structure described in the above embodiment but also to various other coin processing machines such as a coin counting machine or the like.

Further, although in the above described embodiment, a RAM is used as the means for storing the newly stored coin data ND, other appropriate means such as a EEPROM (electrically erasable programmable ROM), a floppy disk or the like can be used. When the floppy disk is used to store the newly stored coin data ND, the CPU 200 is connected to a floppy disk drive and is arranged such that the new coin data registering section 200*a* can access the floppy disk drive to store the coin data ND therein and can read out the coin data RD or ND stored in the ROM 201 or the floppy disk.

Furthermore, in this specification and the appended claims, the respective means need not necessarily be physical means, i.e., and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin processing machine which comprises a rotatable disk receiving deposited coins and feeding out the received coins to a coin sorting passage by a centrifugal force produced by rotation thereof. The coin sorting passage has a pair of guide members. Denomination setting means selects the denomination of coins to be processed, and coin processing means processes the coins which are fed out to the coin sorting passage in accordance with the denomination selected by the denomination setting means. Accordingly, coins of any diameter and thickness can be processed without changing the mechanical arrangement of the coin processing machine.

We claim:

1. A coin processing machine comprising:

a rotatable disk for receiving deposited coins and feeding out said received coins to a coin sorting passage by a centrifugal force produced by rotation thereof, said coin sorting passage including a pair of guide members;

denomination setting means for selecting a denomination of coins to be processed;

coin processing means for processing coins which are fed out to said coin sorting passage in accordance with said denomination selected by said denomination setting means;

data storing means for storing coin data concerning said denomination of coins to be processed, said coin data including a diameter and a thickness of said coins to be processed, said data storing means including:

first data storing means for storing permanent coin data, said permanent coin data being read only from said first data storing means, and second data storing means for storing coin data newly stored by said data input means, said newly stored coin data being written into and read from said second data storing means;

data input means for inputting said coin data into said data storing means;

control means for reading out said coin data from said data storing means in accordance with said denomination selected by said denomination setting means so as to control said coin processing means;

passage width adjusting means for adjusting a spacing between said pair of guide members;

transporting belt means for holding coins in said coin sorting passage between a lower surface of said transporting belt means and an upper surface of said coin sorting passage, and for transporting coins;

transporting belt position adjusting means for adjusting a vertical position of said transporting belt means;

coin stacking means for stacking coins to be wrapped after passing through said coin sorting passage;

coin support post means for receiving and supporting on an upper surface thereof coins stacked in said coin stacking means at a post waiting position immediately below said coin stacking means;

coin wrapping means including a plurality of wrapping rollers, said coin wrapping means for winding a wrapping film around said stacked coins supported by said coin support post means, thereby wrapping said stacked coins and producing a wrapped coin roll;

support post moving means for moving said coin support post means between said post waiting position immediately below said coin stacking means, a post wrapping position where said stacked coins supported by said coin support post means can be wrapped by said coin wrapping means, and a post retracted position where said coin support post means is retracted from between said plurality of wrapping rollers; and first wrapping roller moving means for moving said plurality of wrapping rollers between respective wrapping roller wrapping positions where said coins are wrapped, and respective wrapping roller waiting positions where said plurality of wrapping rollers are slightly more apart from each other than in said respective wrapping roller wrapping positions;

said control means reading out from said data storing means said coin diameter data and said coin thickness data of said denomination of coins to be processed in accordance with said denomination selected by said denomination setting means, and said control means outputting said coin diameter data and said coin thickness data so as to adjust said spacing between said pair of guide members and so as to adjust said vertical position of said transporting belt means;

said coin data includes coin thickness data; and said support post moving means lowering said coin support post means by a distance corresponding substantially to a thickness of one coin based on said coin thickness data of coins to be wrapped read out from said data storing means by said control means each time said coin support post means receives one coin during a time period between a first time when said coin stacking means has stacked a first predetermined number of coins smaller than a second predetermined number of coins corresponding to a total number of coins to be wrapped in each said wrapped coin roll, and a second time when said coin support post means supports said coins in said second predetermined number corresponding to said total number of coins to be wrapped.

2. A coin processing machine according to claim 1, wherein said coin data includes a reference wrapping unit number data indicating said total number of coins to be wrapped in one wrapped coin roll, and said second predetermined number of coins corresponding to said total number of coins is determined based upon said reference wrapping unit number data.

3. A coin processing machine according to claim 1, wherein:

said support post moving means lowers said coin support post means by a distance corresponding substantially to a thickness of one coin each time said coin support post means receives a coin during a time period between a first time when said coin support post means first receives said coins stacked in said coin stacking means and a second time when said coin support post means receives said coins in said second predetermined number corresponding to said total number of coins to be wrapped in one wrapped coin roll on said upper surface thereof; and said support post moving means lowers said coin support post means to said post wrapping position where said stacked coins supported thereby can be wrapped after said coin support post means supports said second predetermined number of coins corresponding to said total number of coins to be wrapped in one wrapped coin roll.

4. A coin processing machine according to claim 1, wherein:

said first wrapping roller moving means moves said plurality of wrapping rollers only by a distance between said respective wrapping roller wrapping positions and said respective wrapping roller waiting positions, said coin processing machine further comprising:

second wrapping roller moving means for moving said plurality of wrapping rollers by a distance between said respective wrapping roller wrapping positions and respective wrapping roller retracted positions where said plurality of wrapping rollers are more apart from each other than in said respective wrapping roller waiting positions;

said support post moving means moving said coin support post means in synchronism with movement of said plurality of wrapping rollers by said first wrapping roller moving means.

5. A coin processing machine according to claim 1, wherein said coin stacking means comprises a pair of stacking blocks each being movable relative to the other.

6. A coin processing machine according to claim 4; further comprising:

shutter means for opening and closing a bottom portion of said coin stacking means, said shutter means closing said bottom portion of said coin stacking means when coins are to be wrapped;

said plurality of wrapping rollers being moved to said respective wrapping roller waiting positions when said coins are to be wrapped;

a width of said coin sorting passage being adjusted by said passage width adjusting means in accordance with said denomination selected by said denomination setting means; and said coin support post means being moved to said post waiting position immediately below said shutter means before said coins stacked in said coin stacking means are transferred to said coin support post means.

7. A coin processing machine comprising:

a rotatable disk for receiving deposited coins and feeding out said received coins to a coin sorting passage by a centrifugal force produced by rotation thereof, said coin sorting passage including a pair of guide members;

denomination setting means for selecting a denomination of coins to be processed;

coin processing means for processing coins which are fed out to said coin sorting passage in accordance with said denomination selected by said denomination setting means;

data storing means for storing coin data concerning said denomination of coins to be processed, said coin data including a diameter and a thickness of said coins to be processed, said data storing means including:

first data storing means for storing permanent coin data, said permanent coin data being read only from said first data storing means, and second data storing means for storing coin data newly stored by said data input means, said newly stored coin data being written into and read from said second data storing means;

data input means for inputting said coin data into said data storing means;

control means for reading out said coin data from said data a storing means in accordance with said denomination selected by said denomination setting means so as to control said coin processing means;

coin stacking means for stacking coins to be wrapped after passing through said coin sorting passage;

coin support post means for receiving and supporting on an upper surface thereof coins stacked in said coin stacking means at a post waiting position immediately below said coin stacking means;

coin wrapping means including a plurality of wrapping rollers, said coin wrapping means for winding a wrapping film around said stacked coins supported by said coin support post means, thereby wrapping said stacked coins and producing a wrapped coin roll;

support post moving means for moving said coin support post means between said post waiting position immediately below said coin stacking means, a post wrapping position where said stacked coins supported by said coin support post means can be wrapped by said coin wrapping means, and a post retracted position where said coin support post means is retracted from between said plurality of wrapping rollers; and first wrapping roller moving means for moving said plurality of wrapping rollers between respective wrapping roller wrapping positions where said coins are wrapped, and respective wrapping roller waiting positions where said plurality of wrapping rollers are slightly more apart from each other than in said respective wrapping roller wrapping positions;

said coin data including coin thickness data;

said support post moving means lowering said coin support post means by a distance corresponding substantially to a thickness of one coin based on said coin thickness data of coins to be wrapped read out from said data storing means by said control means each time said coin support post means receives one coin during a time period between a first time when said coin stacking means has stacked a first predetermined number of coins smaller than a second predetermined number of coins corresponding to a total number of coins to be wrapped in each said wrapped coin roll, and a second time when said coin support post means supports said coins in said second predetermined number corresponding to said total number of coins to be wrapped.

8. A coin processing machine according to claim 7, wherein said coin data includes a reference wrapping unit number data indicating said total number of coins to be wrapped in one wrapped coin roll, and said second predetermined number of coins corresponding to said total number of coins is determined based upon said reference wrapping unit number data.

9. A coin processing machine according to claim 7, wherein:

said support post moving means lowers said coin support post means by a distance corresponding substantially to a thickness of one coin each time said coin support post means receives a coin during a time period between a first time when said coin support post means first receives said coins stacked in said coin stacking means and a second time when said coin support post means receives said coins in said second predetermined number corresponding to said total number of coins to be wrapped in one wrapped coin roll on said upper surface thereof; and said support post moving means lowers said coin support post means to said post wrapping position where said stacked coins supported thereby can be wrapped after said coin support post means supports said second predetermined number of coins corresponding to said total number 0f coins to be wrapped in one wrapped coin roll.

10. A coin processing machine according to claim 7, wherein:

said first wrapping roller moving means moves said plurality of wrapping rollers only by a distance between said respective wrapping roller wrapping positions and said respective wrapping roller waiting positions, said coin processing machine further comprising:

second wrapping roller moving means for moving said plurality of wrapping rollers by a distance between said respective wrapping roller wrapping positions and respective wrapping roller retracted positions where said plurality of wrapping rollers are more apart from each other than in said respective wrapping roller waiting positions;

said support post moving means moving said coin support post means in synchronism with movement of said plurality of wrapping rollers by said first wrapping roller moving means.

11. A coin processing machine according to claim 7, wherein said coin stacking means comprises a pair of stacking blocks each being movable relative to the other.

* * * * *

UNITED STATES PATENT AND TRADEMARK OFFICE

CERTIFICATE OF CORRECTION

PATENT NO. : 5,557,908

DATED : September 24, 1996

INVENTOR(S) : OZEKI et al

It is certified that error appears in the above-indentified patent and that said Letters Patent is hereby corrected as shown below:

On the title page,

Please change

**"[*] Notice: The term of this patent . . . Pat. No. 5,487,2520"**

to

**—[*] Notice: The term of this patent. . . Pat. No. 5,487,252—**

Signed and Sealed this

Ninth Day of September, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,557,908
DATED : Sept. 24, 1996
INVENTOR(S) : Masamichi Ozeki, et al It is certified that error appears in the above-identified patent and that said Letters Patent is hereby corrected as shown below:

On title page, item [73] should read as follows:
--Laural Bank Machines Co., Ltd., Tokyo, Japan--

Signed and Sealed this

Twenty-seventh Day of January, 1998

*Attest:*

Bruce Lehman

BRUCE LEHMAN

*Attesting Officer*

*Commissioner of Patents and Trademarks*